US011447912B2

(12) United States Patent
Hasegawa et al.

(10) Patent No.: US 11,447,912 B2
(45) Date of Patent: Sep. 20, 2022

(54) COMPLEX FIBERS OF CELLULOSE FIBERS WITH INORGANIC PARTICLES AND PROCESSES FOR PREPARING THEM

(71) Applicant: NIPPON PAPER INDUSTRIES CO., LTD., Tokyo (JP)

(72) Inventors: Ayaka Hasegawa, Tokyo (JP); Moe Fuchise, Tokyo (JP); Masatoshi Oishi, Tokyo (JP); Koji Ninagawa, Tokyo (JP); Toru Nakatani, Tokyo (JP)

(73) Assignee: NIPPON PAPER INDUSTRIES CO., LTD., Tokyo (JP)

( * ) Notice: Subject to any disclaimer, the term of this patent is extended or adjusted under 35 U.S.C. 154(b) by 82 days.

(21) Appl. No.: 16/977,812

(22) PCT Filed: Apr. 19, 2019

(86) PCT No.: PCT/JP2019/016812
§ 371 (c)(1),
(2) Date: Sep. 3, 2020

(87) PCT Pub. No.: WO2019/203344
PCT Pub. Date: Oct. 24, 2019

(65) Prior Publication Data

US 2021/0025109 A1 Jan. 28, 2021

(30) Foreign Application Priority Data

Apr. 20, 2018 (JP) ..... JP2018-081400

(51) Int. Cl.

| | |
|---|---|
| ***D06M 11/83*** | (2006.01) |
| ***D06M 11/44*** | (2006.01) |
| ***D21H 17/69*** | (2006.01) |
| *D06M 101/06* | (2006.01) |

(52) U.S. Cl.
CPC ..... *D06M 11/83* (2013.01); *D06M 11/44* (2013.01); *D21H 17/69* (2013.01); *D06M 2101/06* (2013.01)

(58) Field of Classification Search
CPC ..... D06M 11/56; D06M 23/08; D06M 11/76; D06M 11/79; D06M 11/00; D06M 11/45; D06M 11/83; D06M 2101/06; D06M 11/44; D21H 17/69; D21H 15/12; D21H 15/10
USPC ..... 162/181.2
See application file for complete search history.

(56) References Cited

U.S. PATENT DOCUMENTS

| | | | |
|---|---|---|---|
| 5,679,220 | A | 10/1997 | Matthew et al. |
| 5,731,080 | A | 3/1998 | Cousin et al. |
| 2012/0318471 | A1 | 12/2012 | Turkki et al. |
| 2015/0167244 | A1 | 6/2015 | Solismaa |
| 2017/0107668 | A1 | 4/2017 | Fukuoka et al. |
| 2018/0282936 | A1 | 10/2018 | Fukuoka et al. |
| 2019/0282472 | A1 | 9/2019 | Oishi et al. |

FOREIGN PATENT DOCUMENTS

| | | | |
|---|---|---|---|
| CA | 2999970 | A1 | 4/2017 |
| CA | 3032385 | A1 | 2/2018 |
| JP | 4-18193 | A | 1/1992 |
| JP | 6-158585 | A | 6/1994 |
| JP | 2013-536329 | A | 9/2013 |
| JP | 2015-199660 | A | 11/2015 |
| WO | 2010/018301 | A2 | 2/2010 |
| WO | 2017/057154 | A1 | 4/2017 |
| WO | 2018/030521 | A1 | 2/2018 |

OTHER PUBLICATIONS

International Search Report and Written Opinion for Application No. PCT/JP2019/016812, dated Jul. 30, 2019, 6 pages.

*Primary Examiner* — Mark Halpern
(74) *Attorney, Agent, or Firm* — McCarter & English, LLP; Steven G. Davis; Wei Song

(57) ABSTRACT

The present invention aims to provide complex fibers of a cellulose fiber with inorganic particles exhibiting better drainage and retention when they are used as materials for forming sheets. In the complexes of the present invention, (1) the weight ratio B/A between the inorganic content (B) in the residue remaining on a 60-mesh sieve (having an opening of 250 μm) after an aqueous suspension of a complex fiber having a solids content of 0.1% is filtered through the sieve and the inorganic content (A) in the complex fiber before treatment is 0.3 or more; or (2) the weight ratio C/A between the inorganic content (C) in fractions corresponding to an effluent volume (L) of 16.00 to 18.50 and an elution time (sec) of 10.6 to 37.3 and the inorganic content (A) in the complex fiber before treatment is 0.3 or more when an aqueous suspension of the complex fiber having a solids content of 0.3% is classified using a fiber classification analyzer under the conditions of a flow rate of 5.7 L/min, a water temperature of 25±1° C., and a total effluent volume of 22 L.

7 Claims, 5 Drawing Sheets

COMPLEX FIBERS OF CELLULOSE FIBERS WITH INORGANIC PARTICLES AND PROCESSES FOR PREPARING THEM

CROSS-REFERENCE TO RELATED APPLICATIONS

This application is a U.S. national stage filing, under 35 U.S.C. § 371(c), of International Application No. PCT/JP2019/016812, filed on Apr. 19, 2019, which claims priority to Japanese Patent Application No. 2018-081400, filed on Apr. 20, 2018. The entire contents of each of the aforementioned applications are incorporated herein by reference.

TECHNICAL FIELD

The present invention relates to complex fibers of a cellulose fiber with inorganic particles and processes for preparing them.

BACKGROUND ART

Fibers such as woody fibers have various properties based on the functional groups or the like on their surface, but sometimes require surface modification depending on the purposes, and therefore techniques for modifying the surface of the fibers have already been developed.

For example, a technique for precipitating inorganic particles on a fiber such as a cellulose fiber is disclosed in PTL 1, which describes a complex comprising crystalline calcium carbonate mechanically bonded onto a fiber. Further, PTL 2 describes a technique for preparing a complex of a pulp with calcium carbonate by precipitating calcium carbonate in a suspension of the pulp by the carbonation process.

CITATION LIST

Patent Literature

PTL 1: JPA 1994-158585
PTL 2: U.S. Pat. No. 5,679,220

SUMMARY OF INVENTION

Technical Problem

In conventional complex fibers comprising a cellulose fiber covered by inorganic particles on its surface, the cellulose fiber and the inorganic particles did not bind together with sufficient strength, so that the cellulose fiber was covered by only small amounts of the inorganic particles or the inorganic particles sometimes drop from the cellulose fiber. Under such circumstances, the present invention aims to provide complex fibers comprising a cellulose fiber strongly covered by a lot of inorganic particles on its surface.

Solution to Problem

The present invention includes, but not limited to, the following:

[1] A complex fiber of a cellulose fiber with inorganic particles, wherein: (1) the weight ratio B/A between the inorganic content (B) in the residue remaining on a 60-mesh sieve (having an opening of 250 μm) after an aqueous suspension of the complex fiber having a solids content of 0.1% is filtered through the sieve and the inorganic content (A) in the complex fiber before treatment is 0.3 or more; or (2) the weight ratio C/A between the inorganic content (C) in fractions corresponding to an effluent volume (L) of 16.00 to 18.50 and an elution time (sec) of 10.6 to 37.3 and the inorganic content (A) in the complex fiber before treatment is 0.3 or more when an aqueous suspension of the complex fiber having a solids content of 0.3% is classified using a fiber classification analyzer under the conditions of a flow rate of 5.7 L/min, a water temperature of 25±1° C., and a total effluent volume of 22 L.

[2] The complex fiber of [1], which has an average fiber length of 0.4 mm or more.

[3] The complex fiber of [1] or [2], wherein the inorganic particles comprise a metal salt of calcium, magnesium, barium or aluminum, or metal particles containing titanium, copper or zinc, or a silicate.

[4] A process for preparing the complex fiber of any one of [1] to [3], comprising: synthesizing inorganic particles in a solution containing a cellulose fiber; and classifying an aqueous suspension of the complex fiber having a solids content of 0.3% using a fiber classification analyzer under the conditions of a flow rate of 5.7 L/min, a water temperature of 25±1° C., and a total effluent volume of 22 L to determine the weight ratio C/A between the inorganic content (C) in fractions corresponding to an effluent volume (L) of 16.00 to 18.50 and an elution time (sec) of 10.6 to 37.3 and the inorganic content (A) in the complex fiber before treatment.

[5] The process of [4], wherein the aqueous suspension of the complex fiber is prepared to have C/A of 0.3 or more.

[6] A process for preparing the complex fiber of any one of [1] to [3], comprising: synthesizing inorganic particles in a solution containing a cellulose fiber; and filtering an aqueous suspension of the complex fiber having a solids content of 0.1% through a 60-mesh sieve (having an opening of 250 μm) to determine the weight ratio B/A of the inorganic content (B) in the residue remaining on the sieve after filtration to the inorganic content (A) in the aqueous solution of the complex fiber before filtration.

[7] The process of [6], wherein the aqueous suspension of the complex fiber is prepared to have B/A of 0.3 or more.

[8] A complex fiber of a cellulose fiber with inorganic particles, obtained by the process of any one of [4] to [7].

[9] A process for preparing a complex fiber sheet, comprising forming a sheet from a complex fiber obtained by the process of any one of [4] to [7].

[10] A method for analyzing a complex fiber of a cellulose fiber with inorganic particles, comprising:

(1) classifying an aqueous suspension of the complex fiber having a solids content of 0.3% using a fiber classification analyzer under the conditions of a flow rate of 5.7 L/min, a water temperature of 25±1° C., and a total effluent volume of 22 L to determine the weight ratio C/A between the inorganic content (C) in fractions corresponding to an effluent volume (L) of 16.00 to 18.50 and an elution time (sec) of 10.6 to 37.3 and the inorganic content (A) in the complex fiber before treatment; or (2) filtering an aqueous suspension of the complex fiber having a solids content of 0.1% through a 60-mesh sieve (having an opening of 250 μm) to determine the weight ratio B/A of the inorganic content (B) in the residue remaining on the sieve after filtration to the inorganic content (A) in the aqueous solution of the complex fiber before filtration.

[11] The method of [10], wherein the complex fiber has an average fiber length of 0.4 mm or more.

[12] The method of [10] or [11], wherein the inorganic particles comprise a metal salt of calcium, magnesium, barium or aluminum, or metal particles containing titanium, copper or zinc, or a silicate.

Advantageous Effects of Invention

According to the present invention, complex fibers comprising a cellulose fiber strongly covered by a lot of inorganic particles on its surface can be obtained.

The inorganic particles and the cellulose fiber bind together more strongly than in conventional complex fibers, so that the inorganic particles rarely drop during dehydration and sheet-forming (i.e., the inorganic particles are efficiently retained in subsequent processes) and drainage is also improved. The improved dewaterability or drainage leads to improved productivity of various products (i.e., increased dewatering speed and sheet-forming speed) as a matter of course, but also the functionality of products made from the complex fibers of the present invention or the like can be improved because the functional inorganic particles rarely drop.

DESCRIPTION OF EMBODIMENTS

Figure 1:
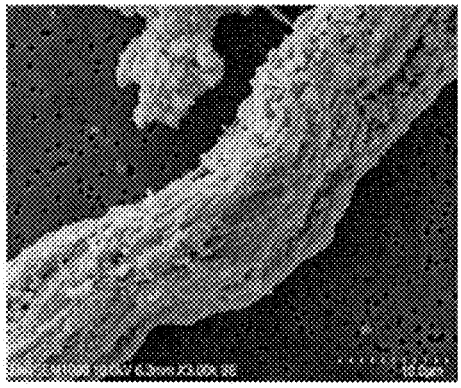
FIG. 1 shows an electron micrograph of Sample 1 (magnification: 3000×).

The present invention relates to complex fibers (complexes) comprising a cellulose fiber strongly covered by inorganic particles on its surface. In preferred embodiments of the complex fibers of the present invention, 15% or more of the surface of the fiber is covered by the inorganic particles.

In the complex fibers of the present invention, the inorganic particles rarely drop from the fiber because the fiber and the inorganic particles bind together via hydrogen bonds or the like rather than simply being mixed. Typically, the binding strength between a fiber and inorganic particles in a complex can be evaluated by, for example, a value such as ash retention (%, i.e., [(the ash content in a sheet)/(the ash content in the complex before disintegration)]×100). Specifically, a complex is dispersed in water to a solids content of 0.2% and disintegrated in a standard disintegrator as defined in JIS P 8220-1: 2012 for 5 minutes, and then formed into a sheet through a 150-mesh wire according to JIS P 8222: 1998, and the ash retention in the resulting sheet can be used for the evaluation. In the present invention, however, even complex fibers that could not be sufficiently evaluated for their binding strength by conventional methods can be evaluated by classifying them to find better complex fibers having high binding strength.

Specifically, it was found that a better complex fiber of a cellulose fiber with inorganic particles having high binding strength can be obtained if:

(1) the weight ratio B/A between the inorganic content (B) in the residue remaining on a 60-mesh sieve (having an opening of 250 μm) after an aqueous suspension of the complex fiber having a solids content of 0.1% is filtered through the sieve and the inorganic content (A) in the complex fiber before treatment is 0.3 or more; or (2) the weight ratio C/A between the inorganic content (C) in fractions corresponding to an effluent volume (L) of 16.00 to 18.50 and an elution time (sec) of 10.6 to 37.3 and the inorganic content (A) in the complex fiber before treatment is 0.3 or more when an aqueous suspension of the complex fiber having a solids content of 0.3% is classified using a fiber classification analyzer under the conditions of a flow rate of 5.7 L/min, a water temperature of 25±1° C., and a total effluent volume of 22 L.

Especially, B/A is preferably 0.5 or more, more preferably 0.6 or more, still more preferably 0.8 or more. On the other hand, C/A is preferably 0.4 or more, more preferably 0.5 or more, still more preferably 0.6 or more.

Complex fibers having B/A of 0.3 or more or C/A of 0.3 or more can be obtained by preparing an aqueous suspension of a complex fiber while controlling the synthesis conditions of the complex fiber, or controlling the concentration of the complex fiber, or classifying the complex fiber or using other methods, as described below.

Synthesis of Complex Fibers

In the present invention, complex fibers can be synthesized by synthesizing inorganic particles in a solution containing a fiber such as a cellulose fiber. This is because the surface of the fiber provides a suitable site where the inorganic particles are precipitated, thus facilitating the synthesis of complex fibers. Processes for synthesizing the complex fibers may comprise stirring/mixing a solution containing a fiber and precursors of inorganic particles in an open reaction vessel to synthesize a complex or injecting an aqueous suspension containing a fiber and precursors of inorganic particles into a reaction vessel to synthesize a complex. As described below, inorganic particles may be synthesized in the presence of cavitation bubbles generated during the injection of an aqueous suspension of a precursor of an inorganic material into a reaction vessel. Inorganic particles can be synthesized on the cellulose fiber by a known reaction in either case.

Generally, inorganic particles are known to be produced through the process of: clustering (repeated association and dissociation of a small number of atoms or molecules), nucleation (transition from a cluster to a stable aggregate in which associated atoms or molecules no longer dissociate when the cluster exceeds a critical size), and growth (capturing of additional atoms or molecules by a nucleus to form a larger particle), and it is said that nucleation is more likely to occur when the concentration of the raw material or the reaction temperature is higher. The complex fibers of the present invention comprising a cellulose fiber strongly covered by inorganic particles on its surface can be obtained primarily by controlling the concentrations of the raw materials, the beating degree (specific surface area) of pulp, the viscosity of the solution containing the fiber, the concentrations and feed rates of chemicals added, the reaction temperature, and the stirring speed so that nuclei are efficiently bound onto the fiber.

In the present invention, a liquid may be injected under conditions where cavitation bubbles are generated in a reaction vessel or a liquid may be injected under conditions where cavitation bubbles are not generated. The reaction vessel is preferably a pressure vessel in either case. As used herein, the term "pressure vessel" refers to a vessel that can withstand a pressure of 0.005 MPa or more. Under conditions where cavitation bubbles are not generated, the pressure in the pressure vessel is preferably 0.005 MPa or more and 0.9 MPa or less expressed in static pressure.

Cavitation Bubbles

For synthesizing the complex fibers of the present invention, inorganic particles can be precipitated in the presence of cavitation bubbles. As used herein, the term "cavitation" refers to a physical phenomenon in which bubbles are generated and disappear in the flow of a fluid in a short time due to a pressure difference. The bubbles generated by cavitation (cavitation bubbles) develop from very small "bubble nuclei" of 100 μm or less present in a liquid when the pressure drops below the saturated vapor pressure in the fluid only for a very short time.

In the present invention, cavitation bubbles can be generated in a reaction vessel by a known method. For example, it is possible to generate cavitation bubbles by injecting a fluid under high pressure, or by stirring at high speed in a fluid, or by causing an explosion in a fluid, or by using an ultrasonic vibrator (vibratory cavitation) or the like.

In the present invention, the reaction solution of raw materials or the like can be directly used as a jet liquid to generate cavitation, or some fluid can be injected into the reaction vessel to generate cavitation bubbles. The fluid forming a liquid jet may be any of a liquid, a gas, or a solid such as powder or pulp or a mixture thereof so far as it is in a flowing state. Moreover, another fluid such as carbonic acid gas can be added as an additional fluid to the fluid described above, if desired. The fluid described above and the additional fluid may be injected as a homogeneous mixture or may be injected separately.

The liquid jet refers to a jet of a liquid or a fluid containing solid particles or a gas dispersed or mixed in a liquid, such as a liquid jet containing a pulp or a raw material slurry of inorganic particles or bubbles. The gas referred to here may contain bubbles generated by cavitation.

The flow rate and pressure are especially important for cavitation because it occurs when a liquid is accelerated and a local pressure drops below the vapor pressure of the liquid. Therefore, the cavitation number a, which is a fundamental dimensionless number representing a cavitation state, is desirably 0.001 or more and 0.5 or less, preferably 0.003 or more and 0.2 or less, especially preferably 0.01 or more and 0.1 or less. If the cavitation number $\sigma$ is less than 0.001, little benefit is obtained because the pressure difference from the surroundings is small when cavitation bubbles collapse, but if it is greater than 0.5, the pressure difference in the flow is too small to generate cavitation.

When cavitation is generated by emitting a jetting liquid through a nozzle or an orifice tube, the pressure of the jetting liquid (upstream pressure) is desirably 0.01 MPa or more and 30 MPa or less, preferably 0.7 MPa or more and 20 MPa or less, more preferably 2 MPa or more and 15 MPa or less. If the upstream pressure is less than 0.01 MPa, little benefit is obtained because a pressure difference is less likely to occur from the downstream pressure. If the upstream pressure is higher than 30 MPa, a special pump and pressure vessel are required and energy consumption increases, leading to cost disadvantages. On the other hand, the pressure in the vessel (downstream pressure) is preferably 0.005 MPa or more and 0.9 MPa or less expressed in static pressure. Further, the ratio between the pressure in the vessel and the pressure of the jetting liquid is preferably in the range of 0.001 to 0.5.

In the present invention, inorganic particles can also be synthesized by injecting a jetting liquid under conditions where cavitation bubbles are not generated. Specifically, the pressure of the jetting liquid (upstream pressure) is controlled at 2 MPa or less, preferably 1 MPa or less, while the pressure of the jetting liquid (downstream pressure) is released, more preferably 0.05 MPa or less.

The jet flow rate of the jetting liquid is desirably in the range of 1 m/sec or more and 200 m/sec or less, preferably in the range of 20 m/sec or more and 100 m/sec or less. If the jet flow rate is less than 1 m/sec, little benefit is obtained because the pressure drop is too small to generate cavitation. If it is greater than 200 m/sec, however, special equipment is required to generate high pressure, leading to cost disadvantages.

In the present invention, cavitation may be generated in the reaction vessel where inorganic particles are synthesized. The process can be run in one-pass mode, or can be run through a necessary number of cycles. Further, the process can be run in parallel or in series using multiple generating means.

Liquid injection for generating cavitation may take place in a vessel open to the atmosphere, but preferably takes place within a pressure vessel to control the cavitation.

When cavitation is generated by liquid injection, the solids content of the reaction solution is preferably 30% by weight or less, more preferably 20% by weight or less. This is because cavitation bubbles are more likely to homogeneously act on the reaction system at such levels. On the other hand, the solids content of the aqueous suspension of slaked lime forming the reaction solution is preferably 0.1% by weight or more to improve the reaction efficiency.

When a complex of calcium carbonate with a cellulose fiber is synthesized in the present invention, for examples, the pH of the reaction solution is basic at the start of the reaction, but changes to neutral as the carbonation reaction proceeds. Thus, the reaction can be controlled by monitoring the pH of the reaction solution.

In the present invention, stronger cavitation can be generated by increasing the jetting pressure of the liquid because the flow rate of the jetting liquid increases and accordingly the pressure decreases. Moreover, the impact force can be stronger by increasing the pressure in the reaction vessel because the pressure in the region where cavitation bubbles collapse increases and the pressure difference between the bubbles and the surroundings increases so that the bubbles vigorously collapse. This also helps to promote the dissolution and dispersion of carbonic acid gas introduced. The reaction temperature is preferably 0° C. or more and 90° C. or less, especially preferably 10° C. or more and 60° C. or less. Given that the impact force is generally thought to be maximal at the midpoint between the melting point and the boiling point, the temperature is suitably around 50° C. in cases of aqueous solutions, though significant effects can be obtained even at a lower temperature so far as it is within the ranges defined above because there is no influence of vapor pressure.

For preparing the complex fibers of the present invention, various known auxiliaries can also be added. For example, chelating agents can be added, specifically including polyhydroxycarboxylic acids such as citric acid, malic acid, and tartaric acid; dicarboxylic acids such as oxalic acid; sugar acids such as gluconic acid; aminopolycarboxylic acids such as iminodiacetic acid and ethylenediaminetetraacetic acid and alkali metal salts thereof; alkali metal salts of polyphosphoric acids such as hexametaphosphoric acid and tripolyphosphoric acid; amino acids such as glutamic acid and aspartic acid and alkali metal salts thereof; ketones such as acetylacetone, methyl acetoacetate and allyl acetoacetate; sugars such as sucrose; and polyols such as sorbitol. Surface-treating agents can also be added, including saturated fatty acids such as palmitic acid and stearic acid; unsaturated fatty acids such as oleic acid and linoleic acid; alicyclic carboxylic acids; resin acids such as abietic acid; as well as salts, esters and ethers thereof; alcoholic activators, sorbitan fatty acid esters, amide- or amine-based surfactants, polyoxyalkylene alkyl ethers, polyoxyethylene nonyl phenyl ether, sodium alpha-olefin sulfonate, long-chain alkylamino acids, amine oxides, alkylamines, quaternary ammonium salts, aminocarboxylic acids, phosphonic acids, polycarboxylic acids, condensed phosphoric acids and the like. Further, dispersants can also be used, if desired. Such dispersants include, for example, sodium polyacrylate, sucrose fatty acid esters, glycerin fatty acid esters, ammonium salts of acrylic acid-maleic acid copolymers, methacrylic acid-naphthoxypolyethylene glycol acrylate copolymers, ammonium salts of methacrylic acid-polyethylene glycol monomethacrylate copolymers, polyethylene glycol monoacrylate and the like. These can be used alone or in combination. They may be added before or after the synthesis reaction. Such additives can be added preferably in an amount of 0.001 to 20%, more preferably 0.1 to 10% of inorganic particles.

Further in the present invention, the reaction can be a batch reaction or a continuous reaction. Typically, the reaction is preferably performed by a batch reaction process because of the convenience in removing residues after the reaction. The scale of the reaction is not specifically limited, and can be 100 L or less, or more than 100 L. The volume of the reaction vessel can be, for example, in the order of 10 L to 100 L, or may be in the order of 100 L to 1000 L.

Furthermore, the reaction can be controlled by the conductivity of the reaction solution or the reaction period, and specifically it can be controlled by adjusting the period during which the reactants stay in the reaction vessel. In the present invention, the reaction can also be controlled by stirring the reaction solution in the reaction vessel or performing the reaction as a multistage reaction.

In the present invention, the reaction product complex fiber is obtained as a suspension so that it can be stored in a storage tank or subjected to further processes such as concentration, dehydration, grinding, classification, aging, or dispersion, as appropriate. These can be accomplished by known processes, which may be appropriately selected taking into account the purpose, energy efficiency and the like. For example, the concentration/dehydration process is performed by using a centrifugal dehydrator, thickener or the like. Examples of such centrifugal dehydrators include decanters, screw decanters and the like. If a filter or dehydrator is used, the type of it is not specifically limited either, and those commonly used can be used, including, for example, pressure dehydrators such as filter presses, drum filters, belt presses and tube presses or vacuum drum filters such as Oliver filters or the like, which can be conveniently used to give a calcium carbonate cake. Grinding means include ball mills, sand grinder mills, impact mills, high pressure homogenizers, low pressure homogenizers, Dyno mills, ultrasonic mills, Kanda grinders, attritors, millstone type mills, vibration mills, cutter mills, jet mills, breakers, beaters, single screw extruders, twin screw extruders, ultrasonic stirrers, juicers/mixers for home use, etc. Classification means include sieves such as meshes, outward or inward flow slotted or round-hole screens, vibrating screens, heavyweight contaminant cleaners, lightweight contaminant cleaners, reverse cleaners, screening testers and the like. Dispersion means include high speed dispersers, low speed kneaders and the like.

The complex fibers in the present invention can be compounded into fillers or pigments as a suspension without being completely dehydrated, or can be dried into powder. The dryer used in the latter case is not specifically limited either, and air-flow dryers, band dryers, spray dryers and the like can be conveniently used, for example.

The complex fibers of the present invention can be modified by known methods. In one embodiment, for example, they can be hydrophobized on their surface to enhance the miscibility with resins or the like.

In the present invention, water is used for preparing suspensions or for other purposes, in which case not only common tap water, industrial water, groundwater, well water and the like can be used, but also ion-exchanged water, distilled water, ultrapure water, industrial waste water, and the water obtained during the separation/dehydration of the reaction solution can be conveniently used.

Further in the present invention, the reaction solution in the reaction vessel can be used in circulation. Thus, the reaction efficiency increases and a desired complex of inorganic particles with a fiber can be readily obtained by circulating the reaction solution to promote stirring of the reaction solution.

Inorganic Particles

In the present invention, the inorganic particles to be complexed with a fiber are not specifically limited, but preferably insoluble or slightly soluble in water. The inorganic particles are preferably insoluble or slightly soluble in water because the inorganic particles are sometimes synthesized in an aqueous system or the fiber complexes are sometimes used in an aqueous system.

As used herein, the term "inorganic particles" refers to a compound of a metal element or a non-metal element. Further, the compound of a metal element refers to the so-called inorganic salt formed by an ionic bond between a metal cation (e.g., $Na^+$, $Ca^+$, $Mg^+$, $Al^{3+}$, $Ba^{2+}$ or the like) and an anion (e.g., $O^{2-}$, $OH^-$, $CO_3^{2-}$, $PO_4^{3-}$, $SO_4^{2-}$, $NO_3^-$, $Si_2O_3^{2-}$, $SiO_3^{2-}$, $Cl^+$, $F^+$, $S^{2-}$ or the like). The compound of a non-metal element includes, for example, a silicate ($SiO_2$) or the like. In the present invention, the inorganic particles are preferably at least partially a metal salt of calcium, magnesium or barium, or the inorganic particles are preferably at least partially a silicate, or a metal salt of aluminum, or metal particles containing titanium, copper, silver, iron, manganese, cerium or zinc.

These inorganic particles can be synthesized by a known method, which may be either a gas-liquid or liquid-liquid method. An example of gas-liquid methods is the carbonation process, according to which magnesium carbonate can be synthesized by reacting magnesium hydroxide and carbonic acid gas, for example. Examples of liquid-liquid methods include the reaction between an acid (e.g., hydrochloric acid, sulfuric acid or the like) and a base (e.g., sodium hydroxide, potassium hydroxide or the like) by neutralization; the reaction between an inorganic salt and an acid or a base; and the reaction between inorganic salts. For example, barium sulfate can be obtained by reacting barium hydroxide and sulfuric acid, or aluminum hydroxide can be obtained by reacting aluminum sulfate and sodium hydroxide, or composite inorganic particles of calcium and aluminum can be obtained by reacting calcium carbonate and aluminum sulfate. Such syntheses of inorganic particles can be performed in the presence of any metal or non-metal compound in the reaction solution, in which case the metal or non-metal compound is efficiently incorporated into the inorganic particles so that it can form a composite with them. For example, composite particles of calcium phosphate and titanium can be obtained by adding phosphoric acid to calcium carbonate to synthesize calcium phosphate in the presence of titanium dioxide in the reaction solution.

(Calcium Carbonate)

Calcium carbonate can be synthesized by, for example, the carbonation process, the soluble salt reaction process, the lime-soda process, the soda process or the like, and in preferred embodiments, calcium carbonate is synthesized by the carbonation process.

Typically, the preparation of calcium carbonate by the carbonation process involves using lime as a calcium source to synthesize calcium carbonate via a slaking step in which water is added to quick lime CaO to give slaked lime $Ca(OH)_2$ and a carbonation step in which carbonic acid gas $CO_2$ is injected into the slaked lime to give calcium carbonate $CaCO_3$. During then, the suspension of slaked lime prepared by adding water to quick lime may be passed through a screen to remove less soluble lime particles contained in the suspension. Alternatively, slaked lime may be used directly as a calcium source. In cases where calcium carbonate is synthesized by the carbonation process in the present invention, the carbonation reaction may be performed in the presence of cavitation bubbles.

In cases where calcium carbonate is synthesized by the carbonation process, the aqueous suspension of slaked lime preferably has a solids content in the order of 0.1 to 40% by weight, more preferably 0.5 to 30% by weight, still more preferably 1 to 20% by weight. If the solids content is low, the reaction efficiency decreases and the production cost increases, but if the solids content is too high, the flowability decreases and the reaction efficiency decreases. In the present invention, calcium carbonate is synthesized in the presence of cavitation bubbles, whereby the reaction solution and carbonic acid gas can be well mixed even if a suspension (slurry) having a high solids content is used.

Aqueous suspensions containing slaked lime that can be used include those commonly used for the synthesis of calcium carbonate, and can be prepared by, for example, mixing slaked lime with water or by slaking (digesting) quick lime (calcium oxide) with water. The slaking conditions include, but not specifically limited to, a CaO concentration of 0.05% by weight or more, preferably 1% by weight or more, and a temperature of 20 to 100° C., preferably 30 to 100° C., for example. Further, the average residence time in the slaking reactor (slaker) is not specifically limited either, but can be, for example, 5 minutes to 5 hours, and preferably within 2 hours. It should be understood that the slaker may be batch or continuous. It should be noted that, in the present invention, the carbonation reactor (carbonator) and the slaking reactor (slaker) may be provided separately, or one reactor may serve as both carbonation reactor and slaking reactor.

In the synthesis of calcium carbonate, the nucleation reaction proceeds more readily when the concentrations of the raw materials (Ca ions, $CO_3$ ions) in the reaction solution are higher and the temperature is higher, but nuclei are less likely to adhere to cellulose fibers and free inorganic particles are more likely to be synthesized in the suspension under such conditions when complex fibers are prepared. Thus, the nucleation reaction must be suitably controlled if one desires to prepare a complex fiber in which calcium carbonate has been strongly bound. Specifically, this can be accomplished by optimizing the concentration of Ca ions and the pulp consistency and reducing the feed rate of $CO_2$ per unit time. For example, the concentration of Ca ions in the reaction vessel is preferably 0.01 mol/L or more and less than 0.20 mol/L. If it is less than 0.01 mol/L, the reaction does not readily proceed, but if it is 0.20 mol/L or more, free inorganic particles are more likely to be synthesized in the suspension. The pulp consistency is preferably 0.5% or more and less than 4.0%. If it is less than 0.5%, the reaction does not readily proceed because the frequency with which the raw materials collide with fibers decreases, but if it is 4.0% or more, homogeneous complexes cannot be obtained due to insufficient stirring. The feed rate of $CO_2$ per unit time is desirably 0.001 mol/min or more and less than 0.010 mol/min per liter of the reaction solution. If it is less than 0.001 mol/min, the reaction does not readily proceed, but if it is 0.010 mol/min or more, free inorganic particles are more likely to be synthesized in the suspension.

(Magnesium Carbonate)

Magnesium carbonate can be synthesized by a known method. For example, basic magnesium carbonate can be synthesized via normal magnesium carbonate from magnesium bicarbonate, which is synthesized from magnesium hydroxide and carbonic acid gas. Magnesium carbonate can be obtained in various forms such as magnesium bicarbonate, normal magnesium carbonate, basic magnesium carbonate and the like depending on the synthesis method, among which basic magnesium carbonate is especially preferred as magnesium carbonate forming part of the fiber complexes of the present invention. This is because magnesium bicarbonate is relatively unstable, while normal magnesium carbonate consists of columnar (needle-like) crystals that may be less likely to adhere to fibers. However, a fiber complex of magnesium carbonate with a fiber in which the surface of the fiber is covered in a fish scale-like pattern can be obtained by allowing the chemical reaction to proceed in the presence of the fiber until basic magnesium carbonate is formed.

Further in the present invention, the reaction solution in the reaction vessel can be used in circulation. Thus, the reaction efficiency increases and desired inorganic particles can be readily obtained by circulating the reaction solution to increase contacts between the reaction solution and carbonic acid gas.

In the present invention, a gas such as carbon dioxide (carbonic acid gas) is injected into the reaction vessel where it can be mixed with the reaction solution. According to the present invention, the reaction can be performed with good efficiency because carbonic acid gas can be supplied to the reaction solution without using any gas feeder such as a fan, blower or the like and the carbonic acid gas is finely dispersed by cavitation bubbles.

In the present invention, the concentration of carbon dioxide in the gas containing carbon dioxide is not specifically limited, but the concentration of carbon dioxide is preferably higher. Further, the amount of carbonic acid gas introduced into the injector is not limited and can be selected as appropriate.

The gas containing carbon dioxide of the present invention may be substantially pure carbon dioxide gas or a mixture with another gas. For example, a gas containing an inert gas such as air or nitrogen in addition to carbon dioxide gas can be used as the gas containing carbon dioxide. Gases containing carbon dioxide other than carbon dioxide gas (carbonic acid gas) that can be conveniently used include exhaust gases discharged from incinerators, coal-fired boilers, heavy oil-fired boilers and the like in papermaking factories. Alternatively, the carbonation reaction can also be performed using carbon dioxide emitted from the lime calcination process.

In the synthesis of magnesium carbonate, the nucleation reaction proceeds more readily when the concentrations of the raw materials (Mg ions, $CO_3$ ions) in the reaction solution are higher and the temperature is higher, but nuclei are less likely to adhere to cellulose fibers and free inorganic particles are more likely to be synthesized in the suspension under such conditions when complex fibers are prepared. Thus, the nucleation reaction must be suitably controlled if one desires to prepare a complex fiber in which magnesium carbonate has been strongly bound. Specifically, this can be accomplished by optimizing the concentration of Mg ions and the pulp consistency and reducing the feed rate of $CO_2$ per unit time. For example, the concentration of Mg ions in the reaction vessel is preferably 0.0001 mol/L or more and less than 0.20 mol/L. If it is less than 0.0001 mol/L, the reaction does not readily proceed, but if it is 0.20 mol/L or more, free inorganic particles are more likely to be synthesized in the suspension. The pulp consistency is preferably 0.5% or more and less than 4.0%. If it is less than 0.5%, the reaction does not readily proceed because the frequency with which the raw materials collide with fibers decreases, but if it is 4.0% or more, homogeneous complexes cannot be obtained due to insufficient stirring. The feed rate of $CO_2$ per unit time is desirably 0.001 mol/min or more and less than 0.010 mol/min per liter of the reaction solution. If it is less than 0.001 mol/min, the reaction does not readily proceed, but if it is 0.010 mol/min or more, free inorganic particles are more likely to be synthesized in the suspension.

(Barium Sulfate)

Barium sulfate is a crystalline ionic compound represented by the formula $BaSO_4$ and composed of barium ions and sulfate ions, and often assumes a plate-like or columnar form and is poorly soluble in water. Pure barium sulfate occurs as colorless crystals, but turns yellowish brown or black gray and translucent when it contains impurities such as iron, manganese, strontium, calcium or the like. It occurs as a natural mineral or can be synthesized by chemical reaction. Especially, synthetic products obtained by chemical reaction are not only used for medical purposes (as radiocontrast agents) but also widely used for paints, plastics, storage batteries and the like by taking advantage of their chemical stability.

In the present invention, complexes of barium sulfate with a fiber can be prepared by synthesizing barium sulfate in a solution in the presence of the fiber. For example, possible methods include the reaction between an acid (e.g., sulfuric acid or the like) and a base by neutralization; the reaction between an inorganic salt and an acid or a base; and the reaction between inorganic salts. For example, barium sulfate can be obtained by reacting barium hydroxide and sulfuric acid or aluminum sulfate, or barium sulfate can be precipitated by adding barium chloride into an aqueous solution containing a sulfate.

In the synthesis of barium sulfate, the nucleation reaction proceeds more readily when the concentrations of the raw materials (Ba ions, $SO_4$ ions) in the solution are higher and the temperature is higher, but nuclei are less likely to adhere to cellulose fibers and free inorganic particles are more likely to be synthesized in the suspension under such conditions when complex fibers are prepared. Thus, the nucleation reaction must be suitably controlled if one desires to prepare a complex fiber in which barium sulfate has been strongly bound. Specifically, this can be accomplished by optimizing the concentration of Ba ions and the pulp consistency and reducing the feed rate of $SO_4$ ions per unit time. For example, the concentration of Ba ions in the reaction vessel is preferably 0.01 mol/L or more and less than 0.20 mol/L. If it is less than 0.01 mol/L, the reaction does not readily proceed, but if it is 0.20 mol/L or more, free inorganic particles are more likely to be synthesized in the suspension. The pulp consistency is preferably 0.5% or more and less than 4.0%. If it is less than 0.5%, the reaction does not readily proceed because the frequency with which the raw materials collide with fibers decreases, but if it is 4.0% or more, homogeneous complexes cannot be obtained due to insufficient stirring. The feed rate of $SO_4$ ions per unit time is desirably 0.005 mol/min or more and less than 0.080 mol/min per liter of the reaction solution. If it is less than 0.001 mol/min, the reaction does not readily proceed, but if it is 0.080 mol/min or more, free inorganic particles are more likely to be synthesized in the suspension (Hydrotalcite)

Hydrotalcite can be synthesized by a known method. For example, hydrotalcite is synthesized via a co-precipitation reaction at controlled temperature, pH and the like by immersing a fiber in an aqueous carbonate solution containing carbonate ions forming interlayers and an alkaline solution (sodium hydroxide or the like) in a reaction vessel, and then adding an acid solution (an aqueous metal salt solution containing divalent metal ions and trivalent metal ions forming host layers). Alternatively, hydrotalcite can also be synthesized via a co-precipitation reaction at controlled temperature, pH and the like by immersing a fiber in an acid solution (an aqueous metal salt solution containing divalent metal ions and trivalent metal ions forming host layers) in a reaction vessel, and then adding dropwise an aqueous carbonate solution containing carbonate ions forming interlayers and an alkaline solution (sodium hydroxide or the like). The reaction typically takes place at ordinary pressure, though a process involving a hydrothermal reaction using an autoclave or the like has also been proposed (JPA 1985-6619).

In the present invention, chlorides, sulfides, nitrates and sulfates of magnesium, zinc, barium, calcium, iron, copper, cobalt, nickel, and manganese can be used as sources of divalent metal ions forming host layers. On the other hand, chlorides, sulfides, nitrates and sulfates of aluminum, iron, chromium and gallium can be used as sources of trivalent metal ions forming host layers.

In the present invention, carbonate ions, nitrate ions, chloride ions, sulfate ions, phosphate ions and the like can be used as interlayer anions. Sodium carbonate is used as a source of carbonate ions, when they are used as interlayer anions. However, sodium carbonate can be replaced by a gas containing carbon dioxide (carbonic acid gas) such as substantially pure carbon dioxide gas or a mixture with another gas. For example, gases containing carbon dioxide that can be conveniently used include exhaust gases discharged from incinerators, coal-fired boilers, heavy oil-fired boilers and the like in papermaking factories. Alternatively, the carbonation reaction can also be performed using carbon dioxide emitted from the lime calcination process.

In the synthesis of hydrotalcite, the nucleation reaction proceeds more readily when the concentrations of the raw materials (metal ions forming host layers, $CO_3$ ions and the like) in the solution are higher and the temperature is higher, but nuclei are less likely to adhere to cellulose fibers and free inorganic particles are more likely to be synthesized in the suspension under such conditions when complex fibers are prepared. Thus, the nucleation reaction must be suitably controlled if one desires to prepare a complex fiber in which hydrotalcite has been strongly bound. Specifically, this can be accomplished by optimizing the concentration of $CO_3$ ions and the pulp consistency and reducing the feed rate of metal ions per unit time. For example, the concentration of $CO_3$ ions in the reaction vessel is preferably 0.01 mol/L or more and less than 0.80 mol/L. If it is less than 0.01 mol/L, the reaction does not readily proceed, but if it is 0.80 mol/L or more, free inorganic particles are more likely to be synthesized in the suspension. The pulp consistency is preferably 0.5% or more and less than 4.0%. If it is less than 0.5%, the reaction does not readily proceed because the frequency with which the raw materials collide with fibers decreases, but if it is 4.0% or more, homogeneous complexes cannot be obtained due to insufficient stirring. The feed rate of metal ions per unit time is desirably 0.001 mol/min or more and less than 0.010 mol/min, more desirably 0.001 mol/min or more and less than 0.005 mol/min per liter of the reaction solution in the case of Mg ions, for example, though it depends on the type of metal. If it is less than 0.001 mol/min, the reaction does not readily proceed, but if it is 0.010 mol/min or more, free inorganic particles are more likely to be synthesized in the suspension.

(Alumina/Silica)

Alumina and/or silica can be synthesized by a known method. When any one or more of an inorganic acid or an aluminum salt is used as a starting material of the reaction, the synthesis is accomplished by adding an alkali silicate. The synthesis can also be accomplished by using an alkali silicate as a starting material and adding any one or more of an inorganic acid or an aluminum salt, but the product adheres better to fibers when an inorganic acid and/or aluminum salt is used as a starting material. Inorganic acids that can be used include, but not specifically limited to, sulfuric acid, hydrochloric acid, nitric acid or the like, for example. Among them, sulfuric acid is especially preferred in terms of cost and handling. Aluminum salts include aluminum sulfate, aluminum chloride, aluminum polychloride, alum, potassium alum and the like, among which aluminum sulfate can be conveniently used. Alkali silicates include sodium silicate or potassium silicate or the like, among which sodium silicate is preferred because of easy availability. The molar ratio of silicate and alkali is not limited, but commercial products having an approximate molar ratio of $SiO_2$:$Na_2O$=3 to 3.4:1 commonly distributed as sodium silicate J3 can be conveniently used.

In the present invention, complex fibers comprising silica and/or alumina deposited on the surface of a fiber are prepared preferably by synthesizing silica and/or alumina on the fiber while maintaining the pH of the reaction solution containing the fiber at 4.6 or less. The reason why this results in complex fibers covered well on the fiber surface is not known in complete detail, but it is believed that complex fibers with high coverage ratio and adhesion ratio can be obtained because trivalent aluminum ions are formed at a high degree of ionization by maintaining a low pH.

In the synthesis of silica and/or alumina, the nucleation reaction proceeds more readily when the concentrations of the raw materials (silicate ions, aluminum ions) in the reaction solution are higher and the temperature is higher, but nuclei are less likely to adhere to cellulose fibers and free inorganic particles are more likely to be synthesized in the suspension under such conditions when complex fibers are prepared. Thus, the nucleation reaction must be suitably controlled if one desires to prepare a complex fiber in which silica and/or alumina has been strongly bound. Specifically, this can be accomplished by optimizing the pulp consistency and reducing the feed rate of silicate ions and aluminum ions added per unit time. For example, the pulp consistency is preferably 0.5% or more and less than 4.0%. If it is less than 0.5%, the reaction does not readily proceed because the frequency with which the raw materials collide with fibers decreases, but if it is 4.0% or more, homogeneous complexes cannot be obtained due to insufficient stirring. The feed rate of silicate ions and aluminum ions added per unit time is desirably 0.001 mol/min or more, more desirably 0.01 mol/min or more per liter of the reaction solution, and it is desirably less than 0.5 mol/min, more desirably less than 0.050 mol/min in the case of aluminum ions, for example. If it is less than 0.001 mol/min, the reaction does not readily proceed, but if it is 0.050 mol/min or more, free inorganic particles are more likely to be synthesized in the suspension.

In one preferred embodiment, the average primary particle size of the inorganic particles in the complex fibers of the present invention can be, for example, 1.5 μm or less, or the average primary particle size can be 1200 nm or less, or 900 nm or less, or the average primary particle size can be even 200 nm or less, or 150 nm or less. On the other hand, the average primary particle size of the inorganic particles can be 10 nm or more. It should be noted that the average primary particle size can be determined from electron micrographs.

Cellulose Fibers

The complex fibers used in the present invention comprise a cellulose fiber complexed with inorganic particles. Examples of cellulose fibers forming part of the complexes that can be used include, without limitation, not only natural cellulose fibers but also regenerated fibers (semisynthetic fibers) such as rayon and lyocell and synthetic fibers and the like. Examples of raw materials of cellulose fibers include pulp fibers (wood pulps and non-wood pulps), cellulose nanofibers, bacterial celluloses, animal-derived celluloses such as Ascidiacea, algae, etc., among which wood pulps may be prepared by pulping wood raw materials. Examples of wood raw materials include softwoods such as *Pinus densiflora, Pinus thunbergii, Abies sachalinensis, Picea jezoensis, Pinus koraiensis, Larix kaempferi, Abies firma, Tsuga sieboldii, Cryptomeria japonica, Chamaecyparis obtusa, Larix kaempferi, Abies veitchii, Picea jezoensis* var. *hondoensis, Thujopsis dolabrata*, Douglas fir (*Pseudotsuga menziesii*), hemlock (*Conium maculatum*), white fir (*Abies concolor*), spruces, balsam fir (*Abies balsamea*), cedars, pines, *Pinus merkusii, Pinus radiata*, and mixed materials thereof; and hardwoods such as *Fagus crenata*, birches, *Alnus japonica*, oaks, *Machilus thunbergii, Castanopsis, Betula platyphylla, Populus nigra* var. *italica*, poplars, *Fraxinus, Populus maximowiczii, Eucalyptus*, mangroves, Meranti, Acacia and mixed materials thereof.

The technique for pulping the wood raw materials (woody raw materials) is not specifically limited, and examples include pulping processes commonly used in the papermaking industry. Wood pulps can be classified by the pulping process and include, for example, chemical pulps obtained by digestion via the kraft process, sulfite process, soda process, polysulfide process or the like; mechanical pulps obtained by pulping with a mechanical force such as a refiner, grinder or the like; semichemical pulps obtained by pulping with a mechanical force after a chemical pretreatment; waste paper pulps; deinked pulps and the like. The wood pulps may have been unbleached (before bleaching) or bleached (after bleaching).

Examples of non-wood pulps include cotton, hemp, sisal (*Agave sisalana*), abaca (*Musa textilis*), flax, straw, bamboo, bagas, kenaf, sugar cane, corn, rice straw, *Broussonetia kazinoki* x *B. papyrifera, Edgeworthia chrysantha* and the like.

The pulp fibers may be unbeaten or beaten, and may be chosen depending on the desired properties of complex sheets to be formed therefrom, but they are preferably beaten. This can be expected to improve the sheet strength and to promote the adhesion of inorganic particles.

Moreover, these cellulosic raw materials can be further treated, whereby they can also be used as powdered celluloses, chemically modified celluloses such as oxidized celluloses, and cellulose nanofibers (CNFs) (microfibrillated celluloses (MFCs), TEMPO-oxidized CNFs, phosphate esters of CNFs, carboxymethylated CNFs, mechanically ground CNFs and the like). Powdered celluloses used in the present invention may be, for example, rod-like crystalline cellulose powders having a defined particle size distribution prepared by purifying/drying and grinding/sieving the undecomposed residue obtained after acid hydrolysis of an accepted pulp fraction, or may be commercially available as KC FLOCK (from Nippon Paper Industries Co., Ltd.), CEOLUS (from Asahi Kasei Chemicals Corp.), AVICEL (from FMC Corporation) and the like. The degree of polymerization of celluloses in the powdered celluloses is preferably in the order of 100 to 1500, and the powdered celluloses preferably have a crystallinity of 70 to 90% as determined by X-ray diffraction and also preferably have a volume average particle size of 1 μm or more and 100 μm or less as determined by a laser diffraction particle size distribution analyzer. Oxidized celluloses used in the present invention can be obtained by oxidation with an oxidizing agent in water in the presence of an N-oxyl compound and a compound selected from the group consisting of a bromide, an iodide or a mixture thereof, for example. Cellulose nanofibers can be obtained by disintegrating the cellulosic raw materials described above. Disintegration methods that can be used include, for example, mechanically grinding or beating an aqueous suspension or the like of a cellulose or a chemically modified cellulose such as an oxidized cellulose using a refiner, high pressure homogenizer, grinder, single screw or multi-screw kneader, bead mill or the like. Cellulose nanofibers may be prepared by using one or a combination of the methods described above. The fiber diameter of the cellulose nanofibers prepared can be determined by electron microscopic observation or the like and falls within the range of, for example, 5 nm to 1000 nm, preferably 5 nm to 500 nm, more preferably 5 nm to 300 nm. During the preparation of the cellulose nanofibers, a given compound can be further added before and/or after the celluloses are disintegrated and/or micronized, whereby it reacts with the cellulose nanofibers to functionalize the hydroxyl groups. Functional groups used for the functionalization include acyl groups such as acetyl, ester, ether, ketone, formyl, benzoyl, acetal, hemiacetal, oxime, isonitrile, allene, thiol, urea, cyano, nitro, azo, aryl, aralkyl, amino, amide, imide, acryloyl, methacryloyl, propionyl, propioloyl, butyryl, 2-butyryl, pentanoyl, hexanoyl, heptanoyl, octanoyl, nonanoyl, decanoyl, undecanoyl, dodecanoyl, myristoyl, palmitoyl, stearoyl, pivaloyl, benzoyl, naphthoyl, nicotinoyl, isonicotinoyl, furoyl and cinnamoyl; isocyanate groups such as 2-methacryloyloxyethyl isocyanate; alkyl groups such as methyl, ethyl, propyl, 2-propyl, butyl, 2-butyl, tert-butyl, pentyl, hexyl, heptyl, octyl, nonyl, decyl, undecyl, dodecyl, myristyl, palmityl, and stearyl; oxirane, oxetane, oxyl, thiirane, thietane and the like. Hydrogens in these substituents may be substituted by a functional group such as hydroxyl or carboxyl. Further, the alkyl groups may partially contain an unsaturated bond. Compounds used for introducing these functional groups are not specifically limited and include, for example, compounds containing phosphate-derived groups, compounds containing carboxylate-derived groups, compounds containing sulfate-derived groups, compounds containing sulfonate-derived groups, compounds containing alkyl groups, compounds containing amine-derived groups and the like. Phosphate-containing compounds include, but not specifically limited to, phosphoric acid and lithium salts of phosphoric acid such as lithium dihydrogen phosphate, dilithium hydrogen phosphate, trilithium phosphate, lithium pyrophosphate, and lithium polyphosphate. Other examples include sodium salts of phosphoric acid such as sodium dihydrogen phosphate, disodium hydrogen phosphate, trisodium phosphate, sodium pyrophosphate, and sodium polyphosphate. Further examples include potassium salts of phosphoric acid such as potassium dihydrogen phosphate, dipotassium hydrogen phosphate, tripotassium phosphate, potassium pyrophosphate, and potassium polyphosphate. Still further examples include ammonium salts of phosphoric acid such as ammonium dihydrogen phosphate, diammonium hydrogen phosphate, triammonium phosphate, ammonium pyrophosphate, ammonium polyphosphate and the like. Among them, preferred ones include, but not specifically limited to, phosphoric acid, sodium salts of phosphoric acid, potassium salts of phosphoric acid, and ammonium salts of phosphoric acid, and more preferred are sodium dihydrogen phosphate and disodium hydrogen phosphate because they allow phosphate groups to be introduced with high efficiency so that they are convenient for industrial applications. Carboxyl-containing compounds include, but not specifically limited to, dicarboxylic compounds such as maleic acid, succinic acid, phthalic acid, fumaric acid, glutaric acid, adipic acid, and itaconic acid; and tricarboxylic compounds such as citric acid, and aconitic acid. Acid anhydrides of carboxyl-containing compounds include, but not specifically limited to, acid anhydrides of dicarboxylic compounds such as maleic anhydride, succinic anhydride, phthalic anhydride, glutaric anhydride, adipic anhydride, and itaconic anhydride. Derivatives of carboxyl-containing compounds include, but not specifically limited to, imides of acid anhydrides of carboxyl-containing compounds, and derivatives of acid anhydrides of carboxyl-containing compounds. Imides of acid anhydrides of carboxyl-containing compounds include, but not specifically limited to, imides of dicarboxylic compounds such as maleimides, succinimides, and phthalimides. Derivatives of acid anhydrides of carboxyl-containing compounds are not specifically limited. For example, they include acid anhydrides of carboxyl-containing compounds in which hydrogen atoms are at least partially substituted by a substituent (e.g., alkyl, phenyl or the like) such as dimethylmaleic anhydride, diethylmaleic anhydride, and diphenylmaleic anhydride. Among the compounds containing carboxylate-derived groups listed above, preferred ones include, but not specifically limited to, maleic anhydride, succinic anhydride and phthalic anhydride because they are convenient for industrial applications and can be readily gasified. Further, the cellulose nanofibers may be functionalized by a compound physically adsorbed rather than chemically bonded to the cellulose nanofibers. Compounds to be physically adsorbed include surfactants and the like, which may be anionic, cationic, or nonionic. When the celluloses are functionalized as described above before they are disintegrated and/or ground, these functional groups can be removed, giving back the original hydroxyl groups after they are disintegrated and/or ground. The functionalization as described above can promote disintegration into cellulose nanofibers or help cellulose nanofibers to be mixed with various materials during their use.

The fibers shown above may be used alone or as a mixture of two or more of them. For example, fibrous materials collected from waste water of a papermaking factory may be supplied to the carbonation reaction of the present invention. Various composite particles including those of various shapes such as fibrous particles can be synthesized by supplying such materials to the reaction vessel.

In the present invention, materials that are incorporated into the product inorganic particles to form composite particles can be used in addition to a fiber. In the present invention, composite particles incorporating inorganic particles, organic particles, polymers or the like can be prepared by synthesizing inorganic particles in a solution containing these materials in addition to a fiber such as a pulp fiber.

The fiber length of the fiber to be complexed is not specifically limited, and the average fiber length can be, for example, in the order of 0.1 μm to 15 mm, or may be 1 μm to 12 mm, 100 μm to 10 mm, 400 μm to 8 mm or the like. Especially in the present invention, the average fiber length is preferably 400 μm or more (0.4 mm or more).

The fiber to be complexed is preferably used in such an amount that 15% or more of the surface of the fiber is covered by inorganic particles, and the weight ratio between the fiber and the inorganic particles can be, for example, 5/95 to 95/5, or may be 10/90 to 90/10, 20/80 to 80/20, 30/70 to 70/30, or 40/60 to 60/40.

In the complex fibers of the present invention, 15% or more of the surface of the fiber is covered by inorganic particles in preferred embodiments, and when the surface of the cellulose fiber is covered at such an area ratio, characteristics attributed to the inorganic particles predominate while characteristics attributed to the fiber surface diminish.

The complex fibers of the present invention can be used in various shapes including, for example, powders, pellets, moldings, aqueous suspensions, pastes, sheets, boards, blocks, and other shapes. Further, the complex fibers can be used as main components with other materials to form molded products such as moldings, particles or pellets. The dryer used to dry them into powder is not specifically limited either, and air-flow dryers, band dryers, spray dryers and the like can be conveniently used, for example.

The complex fibers of the present invention can be used for various applications and they can be widely used for any applications including, for example, papers, fibers, cellulosic composite materials, filter materials, paints, plastics and other resins, rubbers, elastomers, ceramics, glasses, tires, building materials (asphalt, asbestos, cement, boards, concrete, bricks, tiles, plywoods, fiber boards, ceiling materials, wall materials, floor materials, roof materials and the like), furniture, various carriers (catalyst carriers, drug carriers, agrochemical carriers, microbial carriers and the like), adsorbents (decontaminants, deodorants, dehumidifying agents and the like), anti-wrinkle agents, clay, abrasives, modifiers, repairing materials, thermal insulation materials, thermal resistant materials, heat dissipating materials, damp proofing materials, water repellent materials, waterproofing materials, light shielding materials, sealants, shielding materials, insect repellents, adhesives, medical materials, paste materials, discoloration inhibitors, electromagnetic wave absorbers, insulating materials, acoustic insulation materials, interior materials, vibration damping materials, semiconductor sealing materials, radiation shielding materials, and the like. They also can be used for various fillers, coating agents and the like in the applications mentioned above. Among them, they are preferably applied for radiation shielding materials, flame retardant materials, building materials, and thermal insulation materials.

The complex fibers of the present invention may also be applied for papermaking purposes including, for example, printing papers, newsprint papers, inkjet printing papers, PPC papers, kraft papers, woodfree papers, coated papers, coated fine papers, wrapping papers, thin papers, colored woodfree papers, cast-coated papers, carbonless copy papers, label papers, heat-sensitive papers, various fancy papers, water-soluble papers, release papers, process papers, hanging base papers, flame retardant papers (incombustible papers), base papers for laminated boards, printed electronics papers, battery separators, cushion papers, tracing papers, impregnated papers, papers for ODP, building papers, papers for decorative building materials, envelope papers, papers for tapes, heat exchange papers, chemical fiber papers, aseptic papers, water resistant papers, oil resistant papers, heat resistant papers, photocatalytic papers, cosmetic papers (facial blotting papers and the like), various sanitary papers (toilet papers, facial tissues, wipers, diapers, menstrual products and the like), cigarette rolling papers, paperboards (liners, corrugating media, white paperboards and the like), base papers for paper plates, cup papers, baking papers, abrasive papers, synthetic papers and the like. Thus, the present invention makes it possible to provide complexes of a fiber with inorganic particles having a small primary particle size and a narrow particle size distribution so that they can exhibit different properties from those of conventional inorganic fillers having a particle size of more than 2 μm. Further, the complexes of a fiber with inorganic particles can be formed into sheets in which the inorganic particles are not only more readily retained but also uniformly dispersed without being aggregated in contrast to those in which inorganic particles are simply added to a fiber. In preferred embodiments, the inorganic particles in the present invention are not only adhered to the outer surface and the inside of the lumen of the fiber but also produced within microfibrils, as proved by the results of electron microscopic observation.

Further, the complex fibers of the present invention can be used typically in combination with particles known as inorganic fillers and organic fillers or various fibers. For example, inorganic fillers include calcium carbonate (precipitated calcium carbonate, ground calcium carbonate), magnesium carbonate, barium carbonate, aluminum hydroxide, calcium hydroxide, magnesium hydroxide, zinc hydroxide, clay (kaolin, calcined kaolin, delaminated kaolin), talc, zinc oxide, zinc stearate, titanium dioxide, silica products prepared from sodium silicate and a mineral acid (white carbon black, silica/calcium carbonate complexes, silica/titanium dioxide complexes), terra alba, bentonite, diatomaceous earth, calcium sulfate, zeolite, inorganic fillers consisting of the ash produced and recycled from the deinking process and inorganic fillers consisting of complexes of the ash with silica or calcium carbonate formed during recycling, etc. Calcium carbonate-silica complexes include not only calcium carbonate and/or precipitated calcium carbonate-silica complexes but also those complexes using amorphous silica such as white carbon black. Organic fillers include urea-formaldehyde resins, polystyrene resins, phenol resins, hollow microparticles, acrylamide complexes, wood-derived materials (microfibers, microfibrillar fibers, kenaf powders), modified/insolubilized starches, ungelatinized starches and the like. Fibers that can be used include, without limitation, not only natural fibers such as celluloses but also synthetic fibers artificially synthesized from raw materials such as petroleum, regenerated fibers (semisynthetic fibers) such as rayon and lyocell, and even inorganic fibers and the like. In addition to the examples mentioned above, natural fibers include protein fibers such as wool and silk yarns and collagen fibers; complex carbohydrate fibers such as chitin-chitosan fibers and alginate fibers and the like. Examples of cellulosic raw materials include pulp fibers (wood pulps and non-wood pulps), bacterial celluloses, animal-derived celluloses such as Ascidiacea, algae, etc., among which wood pulps may be prepared by pulping wood raw materials. Examples of wood raw materials include softwoods such as *Pinus densiflora, Pinus thunbergii, Abies sachalinensis, Picea jezoensis, Pinus koraiensis, Larix kaempferi, Abies firma, Tsuga sieboldii, Cryptomeria japonica, Chamaecyparis obtusa, Larix kaempferi, Abies veitchii, Picea jezoensis* var. *hondoensis, Thujopsis dolabrata*, Douglas fir (*Pseudotsuga menziesii*), hemlock (*Conium maculatum*), white fir (*Abies concolor*), spruces, balsam fir (*Abies balsamea*), cedars, pines, *Pinus merkusii, Pinus radiata*, and mixed materials thereof; and hardwoods such as *Fagus crenata*, birches, *Alnus japonica*, oaks, *Machilus thunbergii, Castanopsis, Betula platyphylla, Populus nigra* var. *italica*, poplars, *Fraxinus, Populus maximowiczii, Eucalyptus*, mangroves, Meranti, Acacia and mixed materials thereof. The technique for pulping the wood raw materials is not specifically limited, and examples include pulping processes commonly used in the papermaking industry. Wood pulps can be classified by the pulping process and include, for example, chemical pulps obtained by digestion via the kraft process, sulfite process, soda process, polysulfide process or the like; mechanical pulps obtained by pulping with a mechanical force such as a refiner, grinder or the like; semichemical pulps obtained by pulping with a mechanical force after a chemical pretreatment; waste paper pulps; deinked pulps and the like. The wood pulps may have been unbleached (before bleaching) or bleached (after bleaching). Examples of non-wood pulps include cotton, hemp, sisal (*Agave sisalana*), abaca (*Musa textilis*), flax, straw, bamboo, bagas, kenaf, sugar cane, corn, rice straw, *Broussonetia kazinoki* x *B. papyrifera, Edgeworthia chrysantha* and the like. The wood pulps and non-wood pulps may be unbeaten or beaten. Moreover, these cellulosic raw materials can be further treated so that they can also be used as powdered celluloses, chemically modified celluloses such as oxidized celluloses, and cellulose nanofibers (CNFs) (microfibrillated celluloses (MFCs), TEMPO-oxidized CNFs, phosphate esters of CNFs, carboxymethylated CNFs, mechanically ground CNFs). Synthetic fibers include polyesters, polyamides, polyolefins, and acrylic fibers; semisynthetic fibers include rayon, acetate and the like; and inorganic fibers include glass fiber, carbon fiber, various metal fibers and the like. All these may be used alone or as a combination of two or more of them.

The average particle size or shape or the like of the inorganic particles forming part of the complex fibers of the present invention can be identified by electron microscopic observation. Further, inorganic particles having various sizes or shapes can be complexed with a fiber by controlling the conditions under which the inorganic particles are synthesized.

Shapes of the Complex Fibers

In the present invention, the complex fibers described above can be formed into various molded products (articles). For example, the complex fibers of the present invention can be readily formed into sheets having a high ash content. Further, the resulting sheets can be laminated to form multilayer sheets.

Paper machines (sheet-forming machines) used for preparing sheets include, for example, Fourdrinier machines, cylinder machines, gap formers, hybrid formers, multilayer paper machines, known sheet-forming machines combining the papermaking methods of these machines and the like. The linear pressure in the press section of the paper machines and the linear calendering pressure in a subsequent optional calendering process can be both selected within a range convenient for the runnability and the performance of the complex fiber sheets. Further, the sheets thus formed may be impregnated or coated with starches, various polymers, pigments and mixtures thereof.

During sheet forming, wet and/or dry strength additives (paper strength additives) can be added. This allows the strength of the complex fiber sheets to be improved. Strength additives include, for example, resins such as urea-formaldehyde resins, melamine-formaldehyde resins, polyamides, polyamines, epichlorohydrin resins, vegetable gums, latexes, polyethylene imines, glyoxal, gums, mannogalactan polyethylene imines, polyacrylamide resins, polyvinylamines, and polyvinyl alcohols; composite polymers or copolymers composed of two or more members selected from the resins listed above; starches and processed starches; carboxymethyl cellulose, guar gum, urea resins and the like. The amount of the strength additives to be added is not specifically limited.

Further, high molecular weight polymers or inorganic materials can also be added to promote the adhesion of fillers to fibers or to improve the retention of fillers or fibers. For example, coagulants can be added, including cationic polymers such as polyethylene imines and modified polyethylene imines containing a tertiary and/or quaternary ammonium group, polyalkylene imines, dicyandiamide polymers, polyamines, polyamine/epichlorohydrin polymers, polymers of dialkyldiallyl quaternary ammonium monomers, dialkylaminoalkyl acrylates, dialkylaminoalkyl methacrylates, dialkylaminoalkyl acrylamides and dialkylaminoalkyl methacrylamides with acrylamides, monoamine/epihalohydrin polymers, polyvinylamines and polymers containing a vinylamine moiety as well as mixtures thereof cation-rich zwitterionic polymers containing an anionic group such as a carboxyl or sulfone group copolymerized in the molecules of the polymers listed above; mixtures of a cationic polymer and an anionic or zwitterionic polymer and the like. Further, retention aids such as cationic or anionic or zwitterionic polyacrylamide-based materials can be used. These may be applied as retention systems called dual polymers in combination with at least one or more cationic or anionic polymers or may be applied as multicomponent retention systems in combination with at least one or more anionic inorganic microparticles such as bentonite, colloidal silica, polysilicic acid, microgels of polysilicic acid or polysilicic acid salts and aluminum-modified products thereof or one or more organic microparticles having a particle size of 100 μm or less called micropolymers composed of crosslinked/polymerized acrylamides. Especially when the polyacrylamide-based materials used alone or in combination with other materials have a weight-average molecular weight of 2,000,000 Da or more, preferably 5,000,000 Da or more as determined by intrinsic viscosity measurement, good retention can be achieved, and when the acrylamide-based materials have a molecular weight of 10,000,000 Da or more and less than 30,000,000 Da, very high retention can be achieved. The polyacrylamide-based materials may be in the form of an emulsion or a solution. Specific compositions of such materials are not specifically limited so far as they contain an acrylamide monomer unit as a structural unit therein, but include, for example, copolymers of a quaternary ammonium salt of an acrylic acid ester and an acrylamide, or ammonium salts obtained by copolymerizing an acrylamide and an acrylic acid ester, followed by quaternization. The cationic charge density of the cationic polyacrylamide-based materials is not specifically limited.

Other additives include drainage aids, internal sizing agents, pH modifiers, antifoaming agents, pitch control agents, slime control agents, bulking agents, inorganic particles (the so-called fillers) such as calcium carbonate, kaolin, talc and silica and the like depending on the purposes. The amount of these additives to be used is not specifically limited.

The basic weight (i.e., basis weight: the weight per square meter) of the sheets can be appropriately controlled depending on the purposes, and it is advantageously 60 to 1200 $g/m^2$ for use as, for example, building materials because of high strength and low drying load during preparation. Alternatively, the basis weight of the sheets can be 1200 $g/m^2$ or more, e.g., 2000 to 110000 $g/m^2$.

Molding techniques other than sheet forming may also be used, and molded products having various shapes can be obtained by the so-called pulp molding process involving casting a raw material into a mold and then dewatering by suction and drying it or the process involving spreading a raw material over the surface of a molded product of a resin or metal or the like and drying it, and then releasing the dried material from the substrate or other processes. Further, the complexes can be molded like plastics by mixing them with a resin. Alternatively, the complexes can be formed into boards by compression molding under pressure and heat as typically used for preparing boards of inorganic materials such as cement or gypsum, or can be formed into blocks. The complexes can be not only formed into sheets that can typically be bent or rolled up, but also formed into boards if more strength is needed. They can also be formed into thick masses, i.e., blocks in the form of a rectangular cuboid or a cube, for example.

In the compounding/drying/molding processes shown above, only one complex can be used, or a mixture of two or more complexes can be used. Two or more complexes can be used as a premix of them or can be mixed after they have been individually compounded, dried and molded.

Further, various organic materials such as polymers or various inorganic materials such as pigments may be added to the molded products of the complexes afterwards.

The molded products prepared from the complexes of the present invention can be printed on. The method for printing is not specifically limited, and known methods can be used including, for example, offset printing, silkscreen printing, screen printing, gravure printing, microgravure printing, flexographic printing, letterpress printing, sticker printing, business form printing, on demand printing, furnisher roll printing, inkjet printing and the like. Among them, inkjet printing is preferred in that a comprehensive layout need not be prepared in contrast to offset printing and it can be performed even on large sheets because large size inkjet printers are relatively easily available. On the other hand, flexographic printing can be conveniently used even for molded products having such a shape as a board, molding or block because it can be successfully performed even on molded products having a relatively uneven surface.

Further, the printed image formed by printing may have any type of pattern as desired including, but not specifically limited to, wood texture patterns, stone texture patterns, fabric texture patterns, objective patterns, geometric patterns, letters, symbols, or a combination thereof, or may be filled with a solid color.

EXAMPLES

The present invention will be further explained with reference to specific experimental examples, but the present invention is not limited to these specific examples. Unless otherwise specified, the concentrations, parts and the like as used herein are based on weight, and the numerical ranges are described to include their endpoints.

Experiment 1. Synthesis of Complexes (Complex Fibers of Ba Sulfate with a Cellulose Fiber)

Sample 1, FIG. 1

After 866 g of a 1% pulp slurry (LBKP, CSF=450 mL, average fiber length: about 0.7 mm) and 37.2 g of barium hydroxide octahydrate (from NIPPON CHEMICAL INDUSTRIAL CO., LTD.) were mixed using a Three-One Motor agitator (667 rpm), aluminum sulfate (alum, 49.1 g) was added dropwise at a rate of 0.7 g/min. After completion of the dropwise addition, stirring was continued for 30 minutes to give Sample 1.

Figure 2:
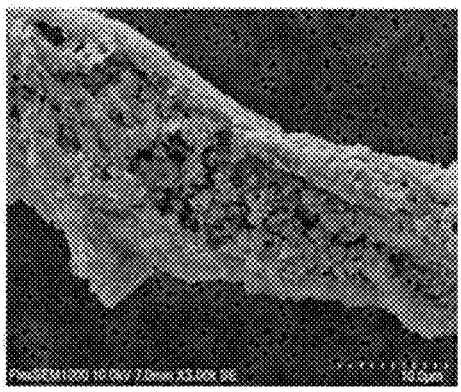
FIG. 2 shows an electron micrograph of Sample 2 (magnification: 3000×).

Sample 2, FIG. 2

After 533 g of a 1.7% pulp slurry (LBKP, CSF=450 mL, average fiber length: about 0.7 mm) and 12.4 g of barium hydroxide octahydrate (from NIPPON CHEMICAL INDUSTRIAL CO., LTD.) were mixed using a Three-One Motor agitator (667 rpm), aluminum sulfate (67.2 g of a 1:4 dilution of alum stock solution in water) was added dropwise at a rate of 1.1 g/min. After completion of the dropwise addition, stirring was continued for 30 minutes to give Sample 2.

Figure 3:
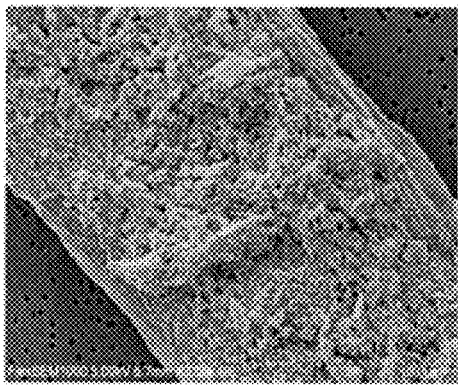
FIG. 3 shows an electron micrograph of Sample 3 (magnification: 3000×).

Sample 3, FIG. 3

After 866 g of a 1% pulp slurry (NBKP, CSF=425 mL, average fiber length: about 1.7 mm) and 37.2 g of barium hydroxide octahydrate (from NIPPON CHEMICAL INDUSTRIAL CO., LTD.) were mixed using a Three-One Motor agitator (667 rpm), aluminum sulfate (alum, 51.3 g) was added dropwise at a rate of 0.8 g/min. After completion of the dropwise addition, stirring was continued for 30 minutes to give Sample 3.

Figure 4:
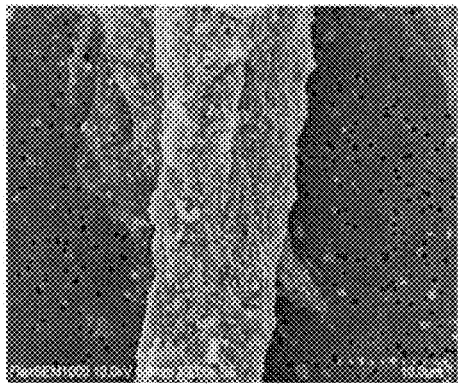
FIG. 4 shows an electron micrograph of Sample 4 (magnification: 3000×).

Sample 4, a Comparative Example, FIG. 4

After 866 g of a 1% pulp slurry (LBKP, CSF=450 mL, average fiber length: about 0.7 mm) and 37.2 g of barium hydroxide octahydrate (from NIPPON CHEMICAL INDUSTRIAL CO., LTD.) were mixed using a Three-One Motor agitator (667 rpm), aluminum sulfate (alum, 51.9 g) was added dropwise at a rate of 2.1 g/min. After completion of the dropwise addition, stirring was continued for 30 minutes to give a complex slurry.

Figure 5:
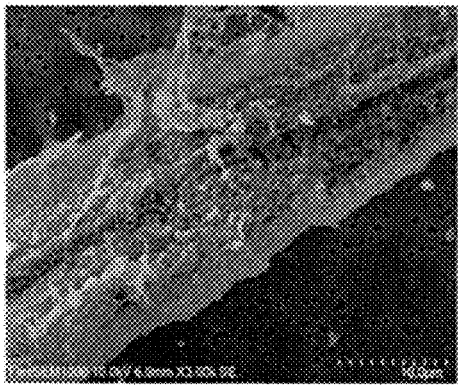
FIG. 5 shows an electron micrograph of Sample 5 (magnification: 3000×).

Sample 5, a Comparative Example, FIG. 5

After 890 g of a 1.0% pulp slurry (LBKP, CSF=450 mL, average fiber length: about 0.7 mm) and 12.4 g of barium hydroxide octahydrate (from NIPPON CHEMICAL INDUSTRIAL CO., LTD.) were mixed using a Three-One Motor agitator (667 rpm), aluminum sulfate (alum, 17.3 g) was added dropwise at a rate of 0.8 g/min. After completion of the dropwise addition, stirring was continued for 30 minutes to give a sample of a complex slurry.

Figure 6:
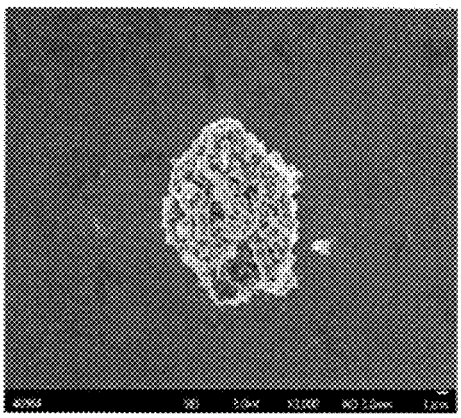
FIG. 6 shows an electron micrograph of Sample 6 (magnification: 3000×).

Sample 6, a Comparative Example, FIG. 6

In a 2-L vessel, 1150 g of water and barium hydroxide octahydrate (from NIPPON CHEMICAL INDUSTRIAL CO., LTD., 49.6 g) were mixed using a Three-One Motor agitator (510 rpm), and then aluminum sulfate (alum, 67.4 g) was added dropwise at a rate of 3.0 g/min. After completion of the dropwise addition, stirring was continued for 30 minutes to give a sample of barium sulfate particles.

Figure 7:
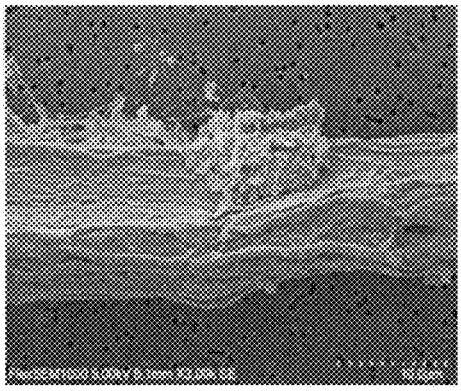
FIG. 7 shows an electron micrograph of Sample 7 (magnification: 3000×).

Sample 7, a Comparative Example, FIG. 7

A mixture of 61 g of a 1% pulp slurry (LBKP, CSF=450 mL, average fiber length: about 0.7 mm) and 62 g of a slurry of barium sulfate particles of Sample 6 (concentration 2.9%) was stirred with water to give a mixed slurry of barium sulfate and a cellulose fiber.

Figure 8:
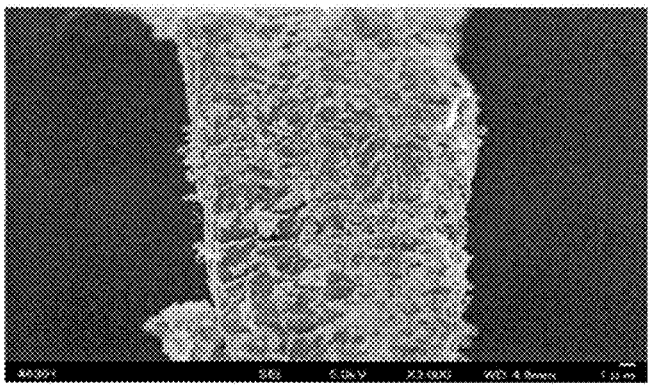
FIG. 8 shows an electron micrograph of Sample 8 (magnification: 3000×).

Sample 8, a Comparative Example, FIG. 8

After 500 g of a 1% pulp slurry (LBKP/NBKP=8/2, average fiber length: about 1.2 mm) and 5.82 g of barium hydroxide octahydrate (from Wako Pure Chemical Industries, Ltd.) were mixed using a Three-One Motor agitator (1000 rpm), sulfuric acid (from Wako Pure Chemical Industries, Ltd., 2.1 g) was added dropwise at a rate of 0.8 g/min. After completion of the dropwise addition, stirring was continued for 30 minutes to give a sample of a complex slurry.

Figure 9:
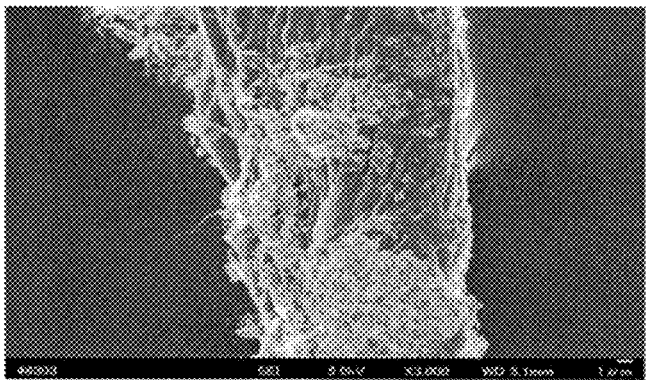
FIG. 9 shows an electron micrograph of Sample 9 (magnification: 3000×).

Sample 9, a Comparative Example, FIG. 9

After 500 g of a 1% pulp slurry (LBKP/NBKP=8/2, average fiber length: about 1.2 mm) and 5.82 g of barium hydroxide octahydrate (from Wako Pure Chemical Industries, Ltd.) were mixed using a Three-One Motor agitator (1000 rpm), sulfuric acid (from Wako Pure Chemical Industries, Ltd., 2.1 g) was added dropwise at a rate of 63.0 g/min. After completion of the dropwise addition, stirring was continued for 30 minutes to give a sample of a complex slurry.

Figure 10:
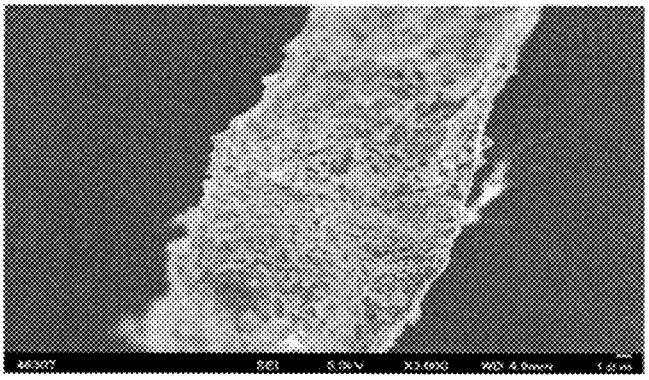
FIG. 10 shows an electron micrograph of Sample 10 (magnification: 3000×).

Sample 10, an Example of the Present Invention, FIG. 10

After 500 g of a 1% pulp slurry (LBKP/NBKP=8/2, average fiber length: about 1.2 mm) and 5.82 g of barium hydroxide octahydrate (from Wako Pure Chemical Industries, Ltd.) were mixed using a Three-One Motor agitator (1000 rpm), sulfuric acid (from Wako Pure Chemical Industries, Ltd., 88 g of a 2% aqueous solution) was added dropwise at a rate of 8.0 g/min. After completion of the dropwise addition, stirring was continued for 30 minutes to give a sample of a complex slurry.

Experiment 2. Synthesis of a Complex (a Complex Fiber of Al Hydroxide with a Cellulose Fiber)

Figure 11:
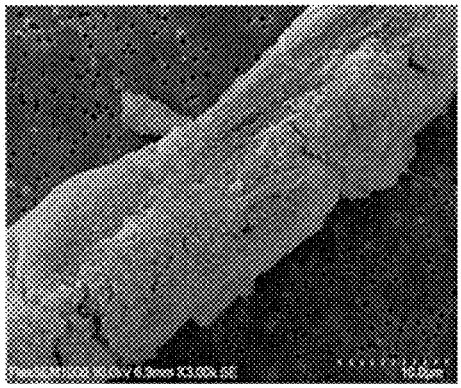
FIG. 11 shows an electron micrograph of Sample A (magnification: 3000×).

Sample A, FIG. 11

After 300 g of a 1% pulp slurry (LBKP, CSF=450 mL, average fiber length: about 0.7 mm) and 3.1 g of sodium hydroxide (from Wako Pure Chemical Industries, Ltd.) were mixed using a Three-One Motor agitator (337 rpm), aluminum sulfate (alum, 19.0 g) was added dropwise at a rate of 0.6 g/min. After completion of the dropwise addition, the reaction solution was stirred for 30 minutes, and washed with about 3 volumes of water to remove the salt, thereby giving Sample A.

Experiment 3. Synthesis of a Complex (a Complex Fiber of Silica/Alumina with a Cellulose Fiber)

Figure 12:
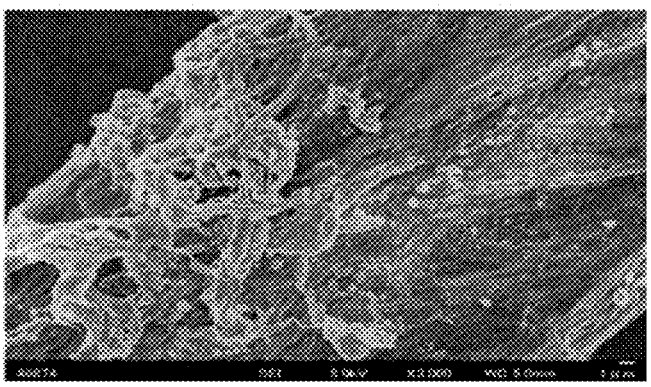
FIG. 12 shows an electron micrograph of Sample B (magnification: 3000×).

Sample B, FIG. 12

In a 2-L resin vessel, 910 g of a 0.5% pulp slurry (NBKP, CSF: 360 mL, average fiber length: about 0.9 mm) was stirred using a laboratory mixer (600 rpm). To this aqueous suspension was added dropwise aluminum sulfate (alum) for about 4 minutes until the pH reached 3.8, and then aluminum sulfate (alum, 156 g) and an aqueous sodium silicate solution (from Wako Pure Chemical Industries, Ltd., concentration 8%, 265 g) were added dropwise at the same time for about 60 minutes to maintain the pH at 4. A peristaltic pump was used for the dropwise addition, and the reaction temperature was about 25° C. Then, an aqueous sodium silicate solution (from Wako Pure Chemical Industries, Ltd., concentration 8%, 200 g) alone was added dropwise for about 80 minutes to adjust the pH at 7.3, thereby giving a sample of a complex slurry.

Experiment 4. Synthesis of Complexes (Complex Fibers of Hydrotalcite with a Cellulose Fiber)

A mixed aqueous solution (acid solution) of $MgSO_4$ (from Wako Pure Chemical Industries, Ltd.) and $Al_2(SO_4)_3$ (from Wako Pure Chemical Industries, Ltd.) was prepared as a solution for synthesizing hydrotalcite (HT). The concentration of $MgSO_4$ was 0.6 M, while the concentration of $Al_2(SO_4)_3$ was 0.1 M.

Figure 13:
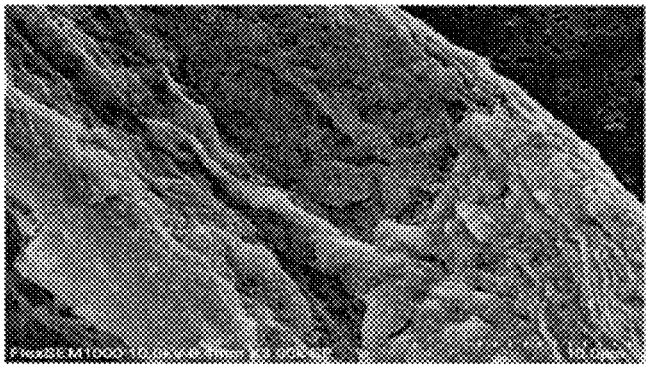
FIG. 13 shows an electron micrograph of Sample C1 (magnification: 3000×).

Sample C1, an Example of the Present Invention, FIG. 13

After 395 g of a 1.9% pulp slurry (NBKP, CSF=425 mL, average fiber length: about 1.7 mm) was mixed with 24.6 g of sodium hydroxide (from Wako Pure Chemical Industries, Ltd.) and 4.0 g of sodium carbonate (from Wako Pure Chemical Industries, Ltd.) using a Three-One Motor agitator (650 rpm), 478.1 g of the acid solution was added dropwise at a rate of 1.5 g/min while keeping the temperature at 50° C. After completion of the dropwise addition, the reaction solution was stirred for 30 minutes, and washed with about 3 volumes of water to remove the salt, thereby giving a sample.

Figure 14:
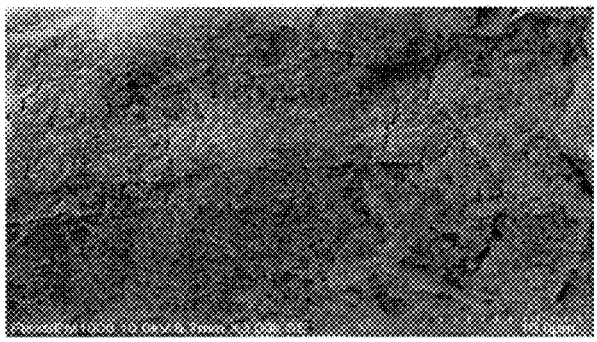
FIG. 14 shows an electron micrograph of Sample C2 (magnification: 3000×).

Sample C2, a Comparative Example, FIG. 14

After 395 g of a 1.9% pulp slurry (NBKP, CSF=425 mL, average fiber length: about 1.7 mm) was mixed with 24.6 g of sodium hydroxide (from Wako Pure Chemical Industries, Ltd.) and 4.0 g of sodium carbonate (from Wako Pure Chemical Industries, Ltd.) using a Three-One Motor agitator (650 rpm), 478.1 g of the acid solution was added dropwise at a rate of 4.6 g/min while keeping the temperature at 50° C. After completion of the dropwise addition, the reaction solution was stirred for 30 minutes, and washed with about 3 volumes of water to remove the salt, thereby giving a sample.

Figure 15:
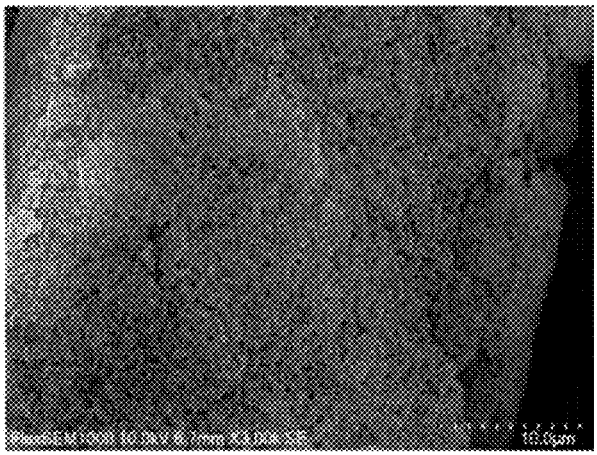
FIG. 15 shows an electron micrograph of Sample C3 (magnification: 3000×).

Sample C3, an Example of the Present Invention, FIG. 15

After 2281 g of a 1.6% pulp slurry (NBKP, CSF=690 mL, average fiber length: about 1.9 mm) was mixed with 88.6 g of sodium hydroxide (from Wako Pure Chemical Industries, Ltd.) and 14.8 g of sodium carbonate (from Wako Pure Chemical Industries, Ltd.) using a Three-One Motor agitator (650 rpm), 1322 g of the acid solution was added dropwise at a rate of 4.6 g/min while keeping the temperature at 50° C. After completion of the dropwise addition, the reaction solution was stirred for 30 minutes, and washed with about 3 volumes of water to remove the salt, and further filtered by suction through a filter paper to give a sample (solids content: about 35%).

TABLE 1

| | | Fiber | | Synthesis conditions of the complex fiber | | | | |
|---|---|---|---|---|---|---|---|---|
| | Inorganic particles | Type | Concentration (%) | Ion concentration in the chemicals added (M) | Feed rate of precursors of inorganic particles per liter of the reaction solution (mol/L/min) | Dropwise addition rate of precursors of inorganic particles (g/min) | Dropwise addition time (min) | Temperature (° C.) |
| Sample 1 (a complex fiber) | Barium sulfate | LBKP | 1.0 | 2.3 [SO4 ions] | 0.03 | 0.7 | 70 | 22 |
| Sample 2 (a complex fiber) | Barium sulfate | LBKP | 1.7 | 0.6 [SO4 ions] | 0.01 | 1.1 | 61 | 23 |
| Sample 3 (a complex fiber) | Barium sulfate | NBKP | 1.0 | 2.3 [SO4 ions] | 0.04 | 0.8 | 64 | 24 |
| Sample 4 (a complex fiber) | Barium sulfate | LBKP | 1.0 | 2.3 [SO4 ions] | 0.09 | 2.1 | 25 | 24 |
| Sample 5 (a complex fiber) | Barium sulfate | LBKP | 1.0 | 2.3 [SO4 ions] | 0.10 | 0.8 | 22 | 22 |
| Sample 6 (inorganic particles alone) | Barium sulfate | — | — | 2.3 [SO4 ions] | 0.10 | 3.0 | 22 | 25 |
| Sample 7 (a mixture) | Barium sulfate | LBKP | 1.0 | — | — | — | — | — |
| Sample 8 (a complex fiber) | Barium sulfate | L/N = 8/2 | 1.0 | 18.3 [SO4 ions] | 13.6 | 0.8 | 2.7 | 21 |
| Sample 9 (a complex fiber) | Barium sulfate | L/N = 8/2 | 1.0 | 18.3 [SO4 ions] | 1220 | 63 | 0.03 | 21 |
| Sample 10 (a complex fiber) | Barium sulfate | L/N = 8/2 | 1.0 | 0.2 [SO4 ions] | 0.04 | 8 | 11 | 21 |
| Sample A (a complex fiber) | Aluminum hydroxide | LBKP | 1.0 | 3.1 [Al ions] | 0.10 | 0.6 | 32 | 23 |
| Sample B (a complex fiber) | Silica/alumina | NBKP | 0.5 | 2.1 [Al ions] | 0.03 | 2.6 | 60 | 25 |
| Sample C1 (a complex fiber) | Hydrotalcite | NBKP | 1.9 | 0.6 [Mg ions] | 0.002 | 1.5 | 315 | 50 |
| Sample C2 (a complex fiber) | Hydrotalcite | NBKP | 1.9 | 0.6 [Mg ions] | 0.006 | 4.6 | 105 | 50 |
| Sample C3 (a complex fiber) | Hydrotalcite | NBKP | 1.6 | 0.6 [Mg ions] | 0.001 | 4.6 | 287 | 50 |

Experiment 5. Evaluation of the Complex Samples (1) Coverage Ratio

Each complex sample obtained was washed with ethanol, and then observed with an electron microscope. The results showed that the inorganic material covered the fiber surface and spontaneously adhered to it in each sample. The coverage ratio of each complex sample is shown in the table below, demonstrating that the coverage ratio was 15% or more in each sample.

Sample 1 (FIG. 1): 85%
Sample 2 (FIG. 2): 90%
Sample 3 (FIG. 3): 95%
Sample 4 (FIG. 4): 90%
Sample 5 (FIG. 5): 90%
Sample 6 (FIG. 6): 0%
Sample 7 (FIG. 7): 10%
Sample 8 (FIG. 8): 85%
Sample 9 (FIG. 9): 60%
Sample 10 (FIG. 10): 95%
Sample A (FIG. 11): 80%
Sample B (FIG. 12): 80%
Sample C1 (FIG. 13): 95%
Sample C2 (FIG. 14): 90%
Sample C3 (FIG. 15): 95%

(2) Screening/Automatic Classification

<The Inorganic Content in the Samples Before Treatment (A)>

Each slurry obtained (3 g on a solids basis) was filtered by suction through a filter paper, and then the residue was dried in an oven (105° C., 2 hours) and the ash content was determined to assess the weight ratio of the inorganic particles in the residue (A).

<Screening of the Complex Samples (B)>

Given that the synthesized slurries also contain (free) inorganic particles not adhered to the fiber, they were screened through a mesh filter in order to numerically represent the amount of the inorganic particles adhered to the fiber. Each complex sample obtained (1 g on a solids basis) was diluted with water to a solids content of 0.1%, and 0.2 liters of the suspension was filtered in its entirety through a 60-mesh sieve (having an opening of 250 μm), and washed with 0.6 liters of water. Then, the ash content in the residue remaining on the sieve after filtration was determined to assess the weight ratio of the inorganic particles (B).

<Automatic Classification of the Complex Samples (C)> In addition to screening, each sample was automatically classified into multiple fractions under predetermined conditions using a fiber classification analyzer (Metso Fractionator). The fractionator is a system that allows a pulp slurry to be automatically classified into five fractions (FRs 1 to 3: long to short fibers; FRs 4 to 5: fine fibers/fillers) according to the elution time after it was passed through a tube having a length of about 100 m at a constant temperature and a constant rate and separated into long fibers to fine fibers/fillers based on the hydrodynamic size.

Each complex sample obtained (3 g on a solids basis) was diluted with water to a solids content of 0.3%, and passed in three portions each weighing about 250 g through the fractionator (at a water temperature of 25±1° C. during classification), and the fractions separated under the effluent conditions shown below were collected.

TABLE 2

| FR | Effluent volume (L) | Elution time (sec) |
|---|---|---|
| 1 | 16.00 to 17.55 | 10.6 to 27.2 |
| 2 | 17.56 to 18.05 | 27.3 to 32.5 |

TABLE 2-continued

| FR | Effluent volume (L) | Elution time (sec) |
|---|---|---|
| 3 | 18.06 to 18.50 | 32.6 to 37.3 |
| 4 | 18.51 to 19.50 | 37.4 to 48.0 |
| 5 | 19.51 to 20.50 | 48.1 to 59.0 |

Each of FRs 1 to 3 collected was allowed to stand in a bucket for several hours until fibrous materials settled, and after the supernatant was discarded, the remaining suspension was filtered by suction through a membrane filter (0.8 μm) to form a mat on the membrane filter. The ash content of the resulting mat was determined to assess the weight ratio of the inorganic particles (C).

(3) Evaluation of the Retention in Sheets

Each of the complex samples obtained (Samples 1 to 10 and Sample A) was prepared into a handsheet having a basis weight of 100 g/m$^2$ according to JIS P 8222: 1998, and the retention of paper stock components was calculated from the basis weight of the sheet.

○: 70% or more

Δ: 50% or more and less than 70%

X: less than 50%

(4) Evaluation of Drainage

Each of the complex samples obtained (Samples 1 to 10 and Sample A) was diluted with water to a solids content of 0.1% to prepare a slurry containing 0.15 g of inorganic solids in total solids, and the slurry was passed through a membrane filter (0.8 μm) under a reduced pressure of 20 mmHg to determine the flow-through time.

◎: less than 2 minutes

○: 2 minutes or more and less than 4 minutes

Δ: 4 minutes or more and less than 6 minutes

X: 6 minutes or more

TABLE 3

| | Inorganic particles | Length-weighted average fiber length (mm) | Coverage ratio (%) | Weight ratio of inorganic particles (%, A) | Residue after filtration (250 μm mesh) Weight ratio of inorganic particles (%, B) |
|---|---|---|---|---|---|
| Sample 1 (a complex fiber) | Barium sulfate | 0.7 | 85 | 74 | 63 |
| Sample 2 (a complex fiber) | Barium sulfate | 0.7 | 90 | 53 | 34 |
| Sample 3 (a complex fiber) | Barium sulfate | 1.7 | 95 | 71 | 60 |
| Sample 4 (a complex fiber) | Barium sulfate | 0.7 | 90 | 73 | 15 |
| Sample 5 (a complex fiber) | Barium sulfate | 0.8 | 90 | 53 | 12 |
| Sample 6 (inorganic particles alone) | Barium sulfate | 0.3 | 0 | 100 | — (not collected) |
| Sample 7 (a mixture) | Barium sulfate | 0.7 | 10 | 75 | 22 |
| Sample 8 (a complex fiber) | Barium sulfate | 1.2 | 85 | 45 | 11 |
| Sample 9 (a complex fiber) | Barium sulfate | 1.2 | 60 | 45 | 9 |
| Sample 10 (a complex fiber) | Barium sulfate | 1.2 | 95 | 45 | 16 |
| Sample A (a complex fiber) | Aluminum hydroxide | 0.7 | 80 | 34 | 12 |
| Sample B (a complex fiber) | Silica/alumina | 1.6 | 80 | 76 | 27 |
| Sample C1 (a complex fiber) | Hydrotalcite | 1.7 | 95 | 77 | 29 |
| Sample C2 (a complex fiber) | Hydrotalcite | 1.7 | 90 | 82 | 15 |
| Sample C3 (a complex fiber) | Hydrotalcite | 1.9 | 95 | 69 | 36 |

TABLE 3-continued

| | Residue after filtration (250 μm mesh) B/A | Automatically classified fractions: Weight ratio of inorganic particles (%, C) | C/A | Result: Retention in sheets | Drainage |
|---|---|---|---|---|---|
| Sample 1 (a complex fiber) | 0.85 | 48 | 0.65 | ○ | ○ |
| Sample 2 (a complex fiber) | 0.65 | 29 | 0.55 | ○ | ◎ |
| Sample 3 (a complex fiber) | 0.84 | 46 | 0.65 | ○ | ○ |
| Sample 4 (a complex fiber) | 0.20 | 16 | 0.22 | Δ | X |
| Sample 5 (a complex fiber) | 0.22 | 14 | 0.26 | Δ | Δ |
| Sample 6 (inorganic particles alone) | — | — (not collected) | — | X | X |
| Sample 7 (a mixture) | 0.29 | 21 | 0.27 | Δ | Δ |
| Sample 8 (a complex fiber) | 0.25 | 9 | 0.20 | Δ | Δ |
| Sample 9 (a complex fiber) | 0.20 | 7 | 0.16 | Δ | Δ |
| Sample 10 (a complex fiber) | 0.36 | 16 | 0.34 | ○ | ○ |
| Sample A (a complex fiber) | 0.35 | 14 | 0.41 | ○ | ○ |
| Sample B (a complex fiber) | 0.36 | 25 | 0.32 | — | — |
| Sample C1 (a complex fiber) | 0.38 | 31 | 0.41 | — | — |
| Sample C2 (a complex fiber) | 0.19 | 18 | 0.22 | — | — |
| Sample C3 (a complex fiber) | 0.52 | 38 | 0.55 | — | — |

The results showed that complex fiber samples 1 to 3 and 10 containing higher inorganic fractions adhered to the fiber exhibit higher retention when they are formed into sheets as compared with complex fiber samples 4, 5, 8, 9 and mixture sample 7 containing lower inorganic fractions adhered to the fiber. This indicates that high proportions of functional inorganic particles can be incorporated into sheets, which means that sheets having high functional quality can be produced with high efficiency. Further, an evaluation of drainage showed that water is drained from complex fiber samples 1 to 3 and 10 faster than complex fiber samples 4, 5, 8, 9 and mixture sample 7 when they are supposed to be formed into sheets containing equivalent amounts of inorganic particles. This may be attributed to the fact that the amount of free fine particles influencing the drainage decreased in complex fiber samples 1 to 3 and 10 because larger amounts of inorganic particles adhered to the fiber. If the drainage is better, the drying process can be shortened/reduced, leading to improved productivity (reduced web break frequency and increased sheet-forming speed), which means great benefits especially when preparing thick sheets.

The invention claimed is:

1. A process for preparing a complex fiber of a cellulose fiber with inorganic particles, wherein the inorganic particles comprise $BaSO_4$, $CaCO_3$ or hydrotalcite and the complex fiber has a ratio (B/A or C/A) of 0.3 or more;

wherein said process comprises: synthesizing the inorganic particles in a suspension containing 0.5% to 4.0% of a cellulose fiber to obtain the complex fiber, and analyzing the complex fiber to determine the B/A or the C/A of the complex fiber, wherein:

(1) B/A is determined by: filtering an aqueous suspension of the complex fiber having a solids content of 0.1% through a 60-mesh sieve (having an opening of 250 μm); and calculating B/A in which A is an inorganic content of the complex fiber before the filtration, and B is an inorganic content of the complex fiber obtained after the filtration as the residue remaining on the sieve; and (2) C/A is determined by: treating an aqueous suspension of the complex fiber having a solids content of 0.3% using a fiber classification analyzer under the conditions of a flow rate of 5.7 L/min, a water temperature of 25±1° C., and a total elution volume of 22 L; and calculating C/A in which A is an inorganic content of the complex fiber before the classification, and C is an the weight ratio C/A between the inorganic content of the complex fiber in fractions corresponding to an elution volume (L) of 16.00 to 18.50 and an elution time (sec) of 10.6 to 37.3.

2. The process of claim 1, wherein the inorganic particles comprise $CaCO_3$, and the inorganic particles are synthesized under the conditions of: Ca ions being 0.01 mol/L to 0.20 mol/L.

3. The process of claim 1, wherein the inorganic particles comprise $BaSO_4$, and the inorganic particles are synthesized under the conditions of: Ba ions being 0.01 mol/L to 0.20 mol/L.

4. The process of claim 1, wherein the inorganic particles comprise hydrotalcite, and the inorganic particles are synthesized under the conditions of: $CO_3$ ions being 0.01 mol/L to 0.80 mol/L.

5. The process of claim 1, wherein the complex fiber has an average fiber length of 0.4 mm or more.

6. The process of claim 1, wherein the complex fiber has B/A or C/A of 0.5 or more.

7. A process for preparing a complex fiber sheet, comprising forming a sheet from a complex fiber obtained by the process of claim 1.

* * * * *